US009971266B2

(12) United States Patent
Tonegawa et al.

(10) Patent No.: US 9,971,266 B2
(45) Date of Patent: May 15, 2018

(54) METHOD OF PRODUCING TONER FOR DEVELOPING ELECTROSTATIC IMAGES

(71) Applicant: Konica Minolta, Inc., Tokyo (JP)

(72) Inventors: Naoya Tonegawa, Sagamihara (JP); Takanari Kayamori, Kawasaki (JP); Masaharu Matsubara, Hachioji (JP); Kouji Sekiguchi, Tokyo (JP); Atsushi Iioka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/440,573

(22) Filed: Feb. 23, 2017

(65) Prior Publication Data

US 2017/0255115 A1 Sep. 7, 2017

(30) Foreign Application Priority Data

Mar. 2, 2016 (JP) ..... 2016-039577

(51) Int. Cl.
*G03G 9/093* (2006.01)

(52) U.S. Cl.
CPC ..... *G03G 9/09392* (2013.01); *G03G 9/09321* (2013.01); *G03G 9/09328* (2013.01); *G03G 9/09364* (2013.01); *G03G 9/09371* (2013.01)

(58) Field of Classification Search
CPC ..... G03G 9/09392
See application file for complete search history.

(56) References Cited

U.S. PATENT DOCUMENTS

2009/0047593 A1* 2/2009 Vanbesien ..... G03G 9/08795 430/110.2
2016/0154333 A1* 6/2016 Sun ..... G03G 9/09328 430/108.6
2016/0327884 A1* 11/2016 Nakajima ..... G03G 9/08711
2017/0168407 A1* 6/2017 Onishi ..... G03G 9/0804

FOREIGN PATENT DOCUMENTS

JP 2011257526 A 12/2011
JP 2012194314 A 10/2012
JP 2014102446 A 6/2014
WO WO-2011021675 A1 * 2/2011 ..... G03G 9/0804

* cited by examiner

*Primary Examiner* — Christopher D Rodee
(74) *Attorney, Agent, or Firm* — Lucas & Mercanti, LLP

(57) ABSTRACT

A method of producing a toner for developing electrostatic images includes Steps I to III is provided. The toner includes a toner matrix particle having a core-shell structure. The toner matrix particle includes a core particle including an amorphous resin A and a crystalline material, and a shell including an amorphous resin B. The shell includes a phase of the amorphous resin B that is not fused with the core particle at the interface. The amorphous resin A differs from the amorphous resin B.

13 Claims, 1 Drawing Sheet

METHOD OF PRODUCING TONER FOR DEVELOPING ELECTROSTATIC IMAGES

This application is based on Japanese Patent Application No. 2016-039577 filed on Mar. 2, 2016 with Japan Patent Office, the entire content of which is hereby incorporated by reference.

1. FIELD OF THE INVENTION

The present invention relates to a method of producing a toner for developing electrostatic images. In particular, the present invention relates to a method of producing a toner for developing electrostatic images, the toner having high compatibility between thermal resistance during storage and low-temperature fixing properties, exhibiting improved charging properties, and providing high-quality images.

2. DESCRIPTION OF RELATED ART

A toner matrix particle has been proposed which exhibits compatibility between low-temperature fixing properties and thermal resistance during storage and has a structure including a core particle coated with a shell (hereinafter the structure may be referred to as "core-shell structure"). In the matrix particle having a core-shell structure, the core particle generally melts at low temperatures and the shell generally exhibits thermal resistance during storage.

The toner matrix particle contains an amorphous resin, such as a polyester resin exhibiting high compatibility between thermal resistance and fixing properties, or a styrene-acrylic resin having superior anti-charging properties and prepared from a general-purpose monomer at low cost.

Another toner matrix particle has been proposed which includes a core particle and a shell composed of different amorphous resins; for example, a core particle composed of an amorphous vinyl resin (or polyester resin) and a shell composed of an amorphous polyester resin (or vinyl resin), such that the core particle and the shell exhibits different characteristics.

For example, Japanese Unexamined Patent Application Publication No. 2012-194314 discloses a toner matrix particle including a core particle containing a polyester resin and a shell containing a vinyl copolymer (styrene-acrylic) resin. Unfortunately, in the toner matrix particle including the core particle and shell composed of different resins, the compatibility between the core particle and the shell is lower than that in the case where the core particle and the shell are composed of the same resin, and small discrete segments of the shell lie on the surface of the core particle and form convex portions. Thus, the core particle has many exposed portions, resulting in insufficient thermal resistance during storage. In addition, the core particle cannot be evenly coated with an external additive because of the rough surface of the toner matrix particle. Thus, the toner including the core particle may fail to exhibit satisfactory charging properties.

Japanese Unexamined Patent Application Publication No. 2014-102446 discloses a toner including a core particle and a shell composed of an inner layer and an outer layer, wherein the inner layer contains a resin having a solubility parameter (SP) falling within a range between the SP of a resin contained in the core particle and the SP of a resin contained in the outer layer.

Although the resins contained in the inner and outer layers and the core particle have similar SP values, the structure of the resin contained in the core particle still differs from that of the resin contained in the shell, and satisfactory effects was not able to be achieved.

Japanese Unexamined Patent Application Publication No. 2011-257526 discloses a toner including a modified polyester resin containing a styrene-acrylic resin chemically bonded to a polyester resin.

Although the technique disclosed in Japanese Unexamined Patent Application Publication No. 2011-257526 achieves high compatibility between a core particle and a shell, the shell may be composed of non-coated rough domains, resulting in unsatisfactory thermal resistance during storage. Alternatively, a release agent or a colorant may be insufficiently dispersed in the toner, resulting in unsatisfactory charging properties or image quality (e.g., low transfer efficiency at high temperature and high humidity and low GI level).

Thus, a further improvement is required for forming a shell coat or a coat domain on the surface of a core particle such that the shell and the core particle exhibit different functions to enhance the quality of the resultant toner.

SUMMARY OF THE INVENTION

An object of the present invention, which has been conceived in light of the problems and circumstances described above, is to provide a method of producing a toner for developing electrostatic images, the toner having high compatibility between thermal resistance during storage and low-temperature fixing properties, exhibiting improved charging properties, and providing high-quality images.

The present inventors have conducted studies for solving the aforementioned problems and have developed a method of producing a toner for developing electrostatic images, the method involving synthesis of toner matrix particles under specific conditions (e.g., temperature ranges) described below in Steps I to III. The inventors have found that the toner produced by the method has high compatibility between thermal resistance during storage and low-temperature fixing properties, exhibits improved charging properties, and provides high-quality images. The present invention has been accomplished on the basis of this finding.

The present invention to solve the problems described above is characterized by the following aspects.

1. A method of producing a toner for developing electrostatic images, the toner including a toner matrix particle having a core-shell structure, wherein the toner matrix particle including a core particle including an amorphous resin A and a crystalline material, and a shell including an amorphous resin B, the shell including a phase of the amorphous resin B that is not fused with the core particle at the interface, and the amorphous resin A differing from the amorphous resin B, the method including the steps of:

Step I) dispersing at least the amorphous resin A and the crystalline material in an aqueous medium to prepare a dispersion, and adjusting a temperature of the dispersion to be equal to or higher than (a glass transition temperature ($T_{g\text{-}a}$) of the amorphous resin A+10)° C. and equal to or lower than (a melting point ($T_{m\text{-}c}$) of the crystalline material+10)° C., to prepare a core particle dispersion through coagulation and coalescence of at least the amorphous resin A and the crystalline material;

Step II) cooling the core particle dispersion prepared in Step I to a temperature equal to or lower than the glass transition temperature ($T_{g\text{-}a}$) of the amorphous resin A; and Step III) adjusting a temperature of the core particle dispersion to be equal to or higher than (the glass transition temperature ($T_{g-a}$) of the amorphous resin A+5)° C. and equal to or lower than (a glass transition temperature ($T_{g-b}$) of the amorphous resin B+3)° C. after Step II, and then adding a dispersion of the amorphous resin B to the core particle dispersion.

2. The method according to item 1, wherein Expressions 1 and 2 are satisfied in Step III:

$$pH_b \leq pH_a, \text{ and} \quad \text{Expression 1:}$$

$$2 \leq pH_b \leq 5 \quad \text{Expression 2:}$$

where $pH_a$ represents the pH of the core particle dispersion at 25° C., and $pH_b$ represents the pH of the dispersion of the amorphous resin B at 25° C.

3. The method according to item 1, wherein the core particle dispersion cooled in Step II contains a core particle having a shape factor SF-2 of 105 to 140.

4. The method according to item 1, wherein the amorphous resin B added in Step III is a particle having a volume median particle size of 30 to 300 nm.

5. The method according to item 1, wherein the amorphous resin A is a styrene-acrylic resin, and the amorphous resin B is a polyester resin.

6. The method according to item 1, wherein the amorphous resin A is a polyester resin, and the amorphous resin B is a styrene-acrylic resin.

7. The method according to item 5, wherein the polyester resin is an amorphous polyester resin chemically bonded to a styrene-acrylic resin.

8. The method according to item 6, wherein the polyester resin is an amorphous polyester resin chemically bonded to a styrene-acrylic resin.

9. The method according to item 7, wherein the amorphous polyester resin chemically bonded to the styrene-acrylic resin has a styrene-acrylic content of 5 to 30 mass %.

10. The method according to item 8, wherein the amorphous polyester resin chemically bonded to the styrene-acrylic resin has a styrene-acrylic content of 5 to 30 mass %.

11. The method according to item 1, wherein the amorphous resin A has a glass transition temperature $T_{g-a}$ of 35 to 50° C.

12. The method according to item 1, wherein the amorphous resin B has a glass transition temperature $T_{g-b}$ of 53 to 63° C.

13. The method according to item 1, wherein the crystalline material includes a crystalline resin or a release agent selected from a hydrocarbon wax and an ester wax, and the crystallin e material has a melting point ($T_{m-c}$) equal to or higher than (a glass transition temperature ($T_{g-b}$) of the amorphous resin B+3)° C.

14. The method according to item 1, wherein the ratio of the mass of the amorphous resin B added in Step III to the total mass of a binder resin is 5 to 35.

DETAILED DESCRIPTION OF THE INVENTION

Figure 1:
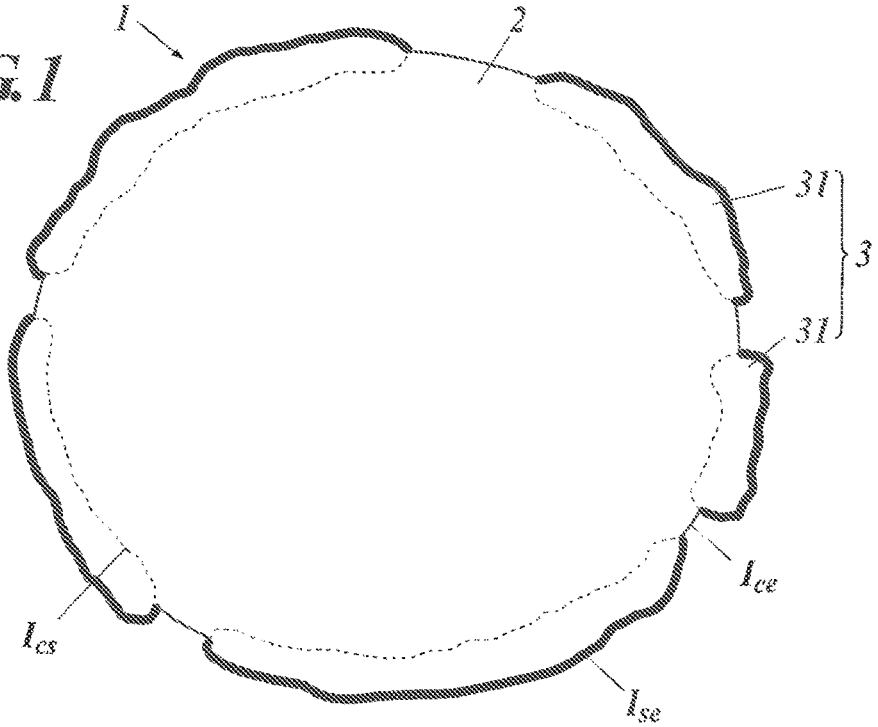
FIG. 1 is a schematic cross-sectional view of a toner matrix particle according to the present invention.

The present invention provides a method of producing a toner for developing electrostatic images, the toner including a toner matrix particle having a core-shell structure. The toner matrix particle includes a core particle including an amorphous resin A and a crystalline material, and a shell including an amorphous resin B. The shell includes a phase of the amorphous resin B that is not fused with the core particle at the interface. The amorphous resin A differs from the amorphous resin B. The method includes Steps I to III described above. These technical characteristics are common in aspects of the present invention.

The mechanisms and operations that establish the advantageous effects of the present invention are inferred as described below.

Since the surface irregularities of the core particles can be reduced through coagulation and coalescence of the amorphous resin A and the crystalline material at a temperature described in Step I according to the present invention, matrix particles having a core-shell structure can be prepared from a minimal amount of the resin for shells. Thus, the toner for developing electrostatic images (hereinafter may be referred to simply as "toner") of the present invention exhibits compatibility between thermal resistance during storage and low-temperature fixing properties. The core particles can be prepared such that a release agent or a colorant is dispersed in the amorphous resin matrix. Accordingly, the resultant toner exhibits superior charging properties and provides high-quality images.

Since the core particles prepared through Step I can be coagulated with and deposited to particles of the amorphous resin B in Steps II and III according to the present invention, the resultant toner exhibits superior charging properties and provides high-quality images. The shell particles composed of the amorphous resin B are deposited onto the surfaces of the core particles while the particle size of the shell particles is maintained. Thus, during coagulation between the core particles and the shell particles, the shell particles form coat domains (rather than non-coated rough domains) to cover the surfaces of the core particles. The resultant toner exhibits superior thermal resistance during storage and charging properties.

As described above, Steps I to III of the method of the present invention involve coagulation and coalescence of different amorphous resins (i.e., a vinyl resin, such as a styrene-acrylic resin, and an amorphous polyester resin) in an aqueous medium to prepare toner matrix particles having a core-shell structure. In these steps, the shell particles composed of the amorphous resin B maintain their form and appropriately coagulate and coat the surfaces of the core particles, resulting in prevention of formation of large particles (domain formation) due to fusion of the shell particles, or intrusion of the shell particles into cores during formation of core-shell composite particles. Thus, the shells form coating layers or coat domains on the surfaces of the toner matrix particles, and the resultant toner for developing electrostatic images exhibits superior thermal resistance during storage and improved charging properties, and provides high-quality images.

In the present invention, Expressions 1 and 2 are preferably satisfied in Step III:

$$pH_b \leq pH_a, \text{ and} \quad \text{Expression 1:}$$

$$2 \leq pH_b \leq 5 \quad \text{Expression 2:}$$

where $pH_a$ represents the pH of the core particle dispersion at 25° C., and $pH_b$ represents the pH of the dispersion of the amorphous resin B at 25° C. This leads to formation of a homogeneous shell deposition layer, resulting in enhanced thermal resistance to a maximal degree during storage.

In the present invention, the dispersion cooled in Step II preferably contains a core particle having a shape factor SF-2 of 105 to 140. This leads to high compatibility between thermal resistance during storage and low-temperature fixing properties.

In the present invention, the amorphous resin B added in Step III is preferably in the form of particles having a volume median particle size of 30 to 300 nm in view of even deposition of the shell and preparation of the shell from a small amount of resin.

In the present invention, preferably, the amorphous resin A is a styrene-acrylic resin and the amorphous resin B is a polyester resin, or the amorphous resin A is a polyester resin and the amorphous resin B is a styrene-acrylic resin. Such a combination of the amorphous resin A and the amorphous resin B is more suitable for formation of domains of the amorphous resin contained in the shell on the surface layer of the toner particle or in the interior of the particle. Thus, the toner for developing electrostatic images produced by the method exhibits superior thermal resistance during storage and improved charging properties and provides high-quality images.

In the present invention, the polyester resin is preferably an amorphous polyester resin chemically bonded to a styrene-acrylic resin in view of an improvement in toner retention after fixation of toner particles.

In the present invention, the amorphous polyester resin chemically bonded to the styrene-acrylic resin preferably has a styrene-acrylic content of 5 to 30 mass % in view of an improvement in releasability of the toner during fixation, and high toner retention after fixation.

In the present invention, the amorphous resin A preferably has a glass transition temperature $T_{g\text{-}a}$ of 35 to 50° C. in view of achievement of low-temperature fixing properties.

In the present invention, the amorphous resin B preferably has a glass transition temperature $T_{g\text{-}b}$ of 53 to 63° C. in view of achievement of thermal resistance during storage.

In the present invention, the crystalline material preferably includes a crystalline resin or a release agent selected from a hydrocarbon wax and an ester wax, and the crystalline material preferably has a melting point ($T_{m\text{-}c}$) equal to or higher than (the glass transition temperature ($T_{g\text{-}b}$) of the amorphous resin B+3)° C., in view of a further improvement in thermal resistance during storage and transfer efficiency.

In the present invention, the ratio of the mass of the amorphous resin B added in Step III to the total mass of the binder resin is preferably 5 to 35 in view of improvements in thermal resistance during storage and releasability during fixation of the toner.

The present invention, its components, and embodiments and aspects for implementing the present invention will now be described in detail. As used herein, the term "to" between two numerical values indicates that the numeric values before and after the term are inclusive as the lower limit value and the upper limit value, respectively.

<<Method of Producing Toner for Developing Electrostatic Images>>

The present invention provides a method of producing a toner for developing electrostatic images, the toner including toner matrix particles each having a core-shell structure. The toner matrix particles each include a core particle including an amorphous resin A and a crystalline material, and a shell including an amorphous resin B. The shell includes a phase of the amorphous resin B that is not fused with the core particle at the interface. The amorphous resin A differs from the amorphous resin B. The method includes Steps I to III described below.

Step I involves dispersing at least the amorphous resin A and the crystalline material in an aqueous medium to prepare a dispersion, and adjusting the temperature of the dispersion to be equal to or higher than (the glass transition temperature ($T_{g\text{-}a}$) of the amorphous resin A+10)° C. and equal to or lower than (the melting point ($T_{m\text{-}c}$) of the crystalline material+10)° C., to prepare a core particle dispersion through coagulation and coalescence of at least the amorphous resin A and the crystalline material.

Step II involves cooling the core particle dispersion prepared in Step I to a temperature equal to or lower than the glass transition temperature ($T_{g\text{-}a}$) of the amorphous resin A.

Step III involves adjusting the temperature of the core particle dispersion to be equal to or higher than (the glass transition temperature ($T_{g\text{-}a}$) of the amorphous resin A+5)° C. and equal to or lower than (the glass transition temperature ($T_{g\text{-}b}$) of the amorphous resin B+3)° C. after Step II, and then adding a dispersion of the amorphous resin B to the core particle dispersion.

In the method of the present invention, the glass transition temperature ($T_{g\text{-}a}$) of the amorphous resin A, the melting point ($T_{m\text{-}c}$) of the crystalline material, and the glass transition temperature ($T_{g\text{-}b}$) of the amorphous resin B are determined as described below. The glass transition temperature ($T_{g\text{-}a}$) of the amorphous resin A, the melting point ($T_{m\text{-}c}$) of the crystalline material, or the glass transition temperature ($T_{g\text{-}b}$) of the amorphous resin B can be controlled by adjustment of the composition (proportions) of monomers for the resin or the molecular weight of the resin.

(Measurement of Melting Point ($T_{m\text{-}c}$) of Crystalline Material)

The melting point of the crystalline material in the toner can be measured with a differential scanning calorimeter "Diamond DSC" (manufactured by PerkinElmer, Inc.). In detail, a sample of the toner (3.0 mg) was sealed in an aluminum pan and placed on a sample holder of the calorimeter. The calorimetry was performed by the following temperature program: a first heating process involving heating from room temperature (25° C.) to 150° C. at a rate of 10° C./min and maintaining at 150° C. for five minutes; a cooling process involving cooling from 150° C. to 0° C. at a rate of 10° C./min and maintaining at 0° C. for five minutes; and a second heating process involving heating from 0° C. to 150° C. at a rate of 10° C./min. An empty aluminum pan was used as a reference.

An endothermic curve prepared through the first heating process was analyzed, and the maximum temperature of the endothermic peak of the crystalline material was defined as the melting point $T_{m\text{-}c}$ (° C.) of the crystalline material. An exothermic curve prepared through the cooling process was analyzed, and the maximum temperature of the exothermic peak of the crystalline material was defined as $T_{q\text{-}c}$ (° C.).

(Measurement of Glass Transition Temperature $T_g$ of Amorphous Resin)

The glass transition temperature ($T_{g\text{-}a}$) of the amorphous resin A and the glass transition temperature ($T_{g\text{-}b}$) of the amorphous resin B can be determined with a differential scanning calorimeter "Diamond DSC" (manufactured by PerkinElmer, Inc.). The temperature of a sample is controlled through sequential processes of heating, cooling, and heating (temperature range: 0 to 150° C., heating rate: 10° C./minute, cooling rate: 10° C./minute). The glass transition temperature can be determined on the basis of the data obtained through the second heating process. In detail, the glass transition temperature corresponds to the intersection of a line extending from the base line of the first endothermic peak and a tangent corresponding to the maximum slope between the rising point and maximum point of the first endothermic peak.

Now will be described components of toner matrix particles and an external additive, the toner matrix particles having a core-shell structure and contained in the toner for developing electrostatic images produced by the method of the present invention and then detailed description of Steps I to III.

[Toner Matrix Particle Having Core-Shell Structure]

The toner matrix particles according to the present invention each have a core-shell structure (hereinafter the particles may be referred to as "core-shell toner matrix particles"). The core-shell structure is composed of a core particle and a shell covering the core particle. The shell may be composed of a large-area coat (hereinafter may be referred to as "shell coat") or several domains of a coat (hereinafter may be referred to as "coat domains"). Unless otherwise specified, the shell coat and the coat domains will be collectively referred to as "shell."

An external additive is optionally applied to the toner matrix particles. The toner matrix particles having the external additive may be used as toner particles. Alternatively, the toner matrix particles having no external additive may be used as toner particles. The toner is composed of such toner particles.

The core particle contains the amorphous resin A and the crystalline material.

The shell contains the amorphous resin B. The shell is composed of a phase of the amorphous resin B that is not fused with the core particle at the interface. The shell and the core particle may be partially fused with each other at the interface therebetween so long as the advantageous effects of the present invention are not inhibited. The presence of such a fused portion probably contributes to further improvements in fracture resistance and toughness of the toner matrix particles.

The amorphous resin A contained in the core particle differs from the amorphous resin B contained in the shell.

Figure 2:
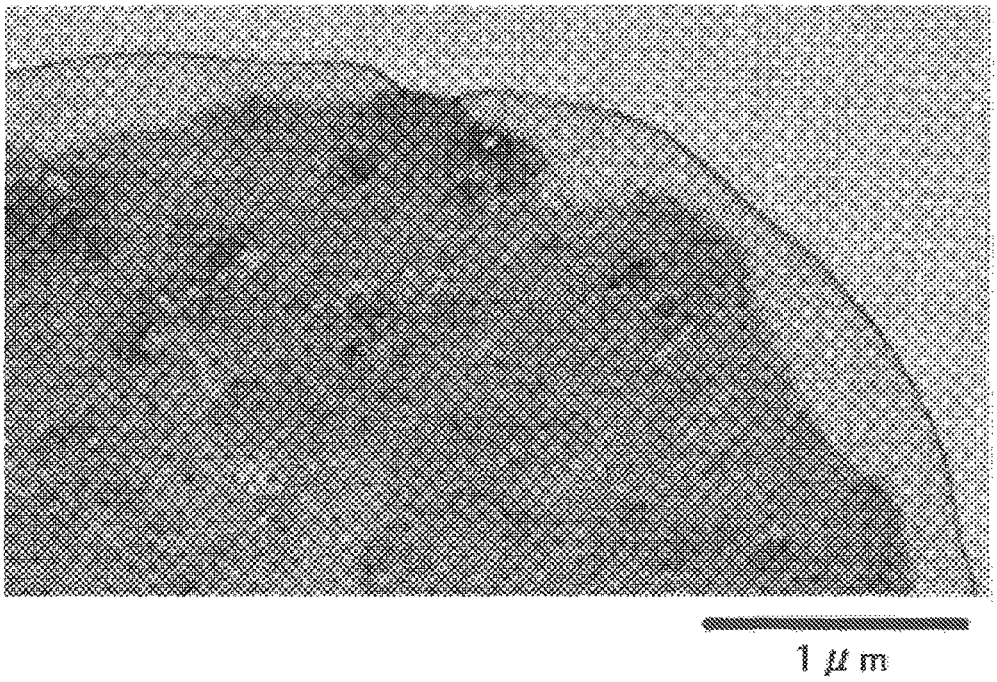
FIG. 2 is an electron microscopic cross-sectional view of a toner matrix particle according to the present invention.

FIG. 1 is a schematic cross-sectional view of a toner matrix particle according to an embodiment of the present invention captured with an electron microscope by the method described below. FIG. 2 is a cross-sectional image of a toner matrix particle.

As illustrated in FIG. 1, a toner matrix particle 1 includes a core particle 2 and a shell 3 covering the surface of the core particle 2. The shell 3 is composed of one or more coat domains 31.

The thick solid line represents the interface $I_{se}$ between the shell and an embedding resin described below. The thin solid line represents the interface $I_{ce}$ between the core particle and the embedding resin. The dotted line represents the interface $I_{cs}$ between the core particle and the shell.

In the toner matrix particle 1 according to the present invention, the shell preferably has a continuous phase; i.e., no cracks in each of the coat domains 31 (like the case shown in FIG. 1), in view of preventing excess elution of the components contained in the core particle 2 through such cracks.

[Amorphous Resin]

The amorphous resin has a glass transition point ($T_g$) but no melting point (i.e., no clear endothermic peak during temperature elevation) in an endothermic curve prepared by differential scanning calorimetry (DSC).

The amorphous resins A and B usable in the present invention are described below. In the toner matrix particles according to the present invention, the amorphous resin A contained in the core particle differs from the amorphous resin B contained in the shell as described above.

As used herein, the amorphous resin A, the amorphous resin B, and the crystalline resin described below may be collectively referred to as "binder resin." Thus, the total mass of the binder resin corresponds to the total mass of the amorphous resin A, the amorphous resin B, and the crystalline resin.

As used herein, the term "different amorphous resins" refers to amorphous resins composed of different types of monomers, and does not refer to amorphous resins having different monomer proportions or amorphous resins having different degrees of modification (e.g., styrene-acrylic modified polyester resins described below). In the core-shell toner containing different amorphous resins (i.e., the amorphous resin A and the amorphous resin B), the core particle or the shell layer contains different amorphous resin components in an amount of 50% or more.

Different types of resins may be detected by any known technique; for example, staining described in Examples, or atomic force microscopy (AFM) for determining the hardness or infrared wavelength of a resin present in a cross section.

The amorphous resin may be of any type, such as a styrene-acrylic resin or an amorphous polyester resin.

Preferably, the amorphous resin A is a styrene-acrylic resin and the amorphous resin B is a polyester resin, or the amorphous resin A is a polyester resin and the amorphous resin B is a styrene-acrylic resin. Such a combination of the amorphous resin A and the amorphous resin B is more suitable for formation of domains of the amorphous resin contained in the shell on the surface layer of the toner particle or in the interior of the particle. Thus, the method of the present invention can produce a toner for developing electrostatic images exhibiting superior thermal resistance during storage and improved charging properties and providing high-quality images.

Particularly preferably, the amorphous resin A is a styrene-acrylic resin and the amorphous resin B is a polyester resin, in view of production of a toner exhibiting charging properties stable against environmental variations (e.g., variations in humidity and temperature) and having superior low-temperature fixing properties.

In view of low-temperature fixing properties, the amorphous resin A has a glass transition temperature $T_{g\text{-}a}$ of preferably 35 to 50° C., more preferably 38 to 48° C.

In view of thermal resistance during storage, the amorphous resin B has a glass transition temperature $T_{g\text{-}b}$ of preferably 53 to 63° C., more preferably 56 to 62° C.

<Styrene-Acrylic Resin>

The styrene-acrylic resin is prepared through polymerization of a styrene monomer and an acrylic monomer.

The styrene-acrylic resin preferably has a weight average molecular weight (Mw) of 25,000 to 60,000 and a number average molecular weight (Mn) of 8,000 to 20,000 in view of the low-temperature fixing properties and gloss stability of the toner.

Examples of the polymerizable monomer used for the styrene-acrylic resin include aromatic vinyl monomers and (meth)acrylate monomers. The polymerizable monomer preferably has a radically polymerizable ethylenically unsaturated bond.

Examples of the aromatic vinyl monomers include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. These aromatic vinyl monomers may be used alone or in combination.

Examples of the (meth)acrylate monomers include n-butyl acrylate, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. These (meth)acrylate monomers may be used alone or in combination. Preferred is a combination of a styrene monomer and an acrylate or methacrylate monomer.

The polymerizable monomer may be a third vinyl monomer. Examples of the third vinyl monomer include acid monomers, such as acrylic acid, methacrylic acid, maleic anhydride, and vinylacetic acid, acrylamide, methacrylamide, acrylonitrile, ethylene, propylene, butylene, vinyl chloride, N-vinylpyrrolidone, and butadiene.

The polymerizable monomer may be a polyfunctional vinyl monomer. Examples of the polyfunctional vinyl monomer include diacrylates of ethylene glycol, propylene glycol, butylene glycol, and hexylene glycol, divinylbenzene, and dimethacrylates and trimethacrylates of tri- or higher-valent alcohols, such as pentaerythritol and trimethylolpropane.

The styrene-acrylic resin according to the present invention is preferably prepared by any known emulsion polymerization process. According to the emulsion polymerization process, the styrene-acrylic resin is prepared through polymerization of a polymerizable monomer (e.g., styrene or acrylate) dispersed in an aqueous medium described below. A surfactant is preferably used for dispersion of the polymerizable monomer in an aqueous medium. A polymerization initiator or a chain transfer agent may be used for polymerization of the polymerizable monomer.

<Amorphous Polyester Resin>

The amorphous polyester resin exhibits a glass transition point ($T_g$) and no melting point (i.e., no clear endothermic peak during temperature elevation) in an endothermic curve prepared by differential scanning calorimetry (DSC).

If the amorphous polyester resin satisfies the aforementioned definitions, the amorphous polyester resin may be derived from any amorphous polyester resin or may include a styrene-acrylic modified polyester resin described below.

The amorphous polyester resin is preferably an amorphous polyester resin chemically bonded to a styrene-acrylic resin (hereinafter may be referred to as "styrene-acrylic modified polyester resin") for the following reason. The incorporation of the styrene-acrylic resin into the main resin (amorphous resin; i.e., binder resin other than crystalline resin) contained in the core particle leads to high compatibility between the styrene-acrylic resin and the main resin, resulting in improved releasability of the core-shell toner during fixation, and high toner retention after fixation.

As used herein, the term "styrene-acrylic modified polyester resin" refers to a resin (hybrid resin) having a polyester molecular structure including an amorphous polyester chain (hereinafter may be referred to as "polyester segment") molecularly bonded to the aforementioned styrene-acrylic copolymer segment. Thus, the styrene-acrylic modified polyester resin has a copolymeric structure including the styrene-acrylic copolymer segment molecularly bonded to the amorphous polyester segment.

The styrene-acrylic modified polyester resin serving as the amorphous polyester resin is clearly distinguished from the hybrid crystalline polyester resin as described below. Unlike the crystalline polyester resin segment of the hybrid crystalline polyester resin, the amorphous polyester segment of the amorphous styrene-acrylic modified polyester resin is an amorphous molecular chain having no clear melting point and a relatively high glass transition temperature ($T_g$). These properties can be confirmed through differential scanning calorimetry (DSC) of the toner. The monomer for the amorphous polyester segment has a chemical structure different from that of the monomer for the crystalline polyester resin segment, and thus these monomers can be distinguished from each other by, for example, NMR analysis.

(Amorphous Polyester Segment)

The amorphous polyester segment is composed of a polyhydric alcohol component and a polyvalent carboxylic acid component.

The polyhydric alcohol component may be of any type. The polyhydric alcohol component is preferably an aromatic diol or a derivative thereof in view of the charging properties and strength of the toner. Examples of the aromatic diol and its derivative include bisphenols, such as bisphenol A and bisphenol F; and alkylene oxide adducts of bisphenols, such as ethylene oxide adducts and propylene oxide adducts of bisphenols.

Among these polyhydric alcohol components, preferred are ethylene oxide adducts and propylene oxide adducts of bisphenol A in view of an improvement in charging uniformity. These polyhydric alcohol components may be used alone or in combination.

The polyvalent carboxylic acid component condensed with the polyhydric alcohol component may be of any type. Examples of the polyvalent carboxylic acid component include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as fumaric acid, maleic anhydride, succinic acid, adipic acid, sebacic acid, and alkenylsuccinic acid; and lower alkyl esters and anhydrides of these acids. These polyvalent carboxylic acid components may be used alone or in combination.

The amorphous polyester resin preferably has a number average molecular weight (Mn) of 2,000 to 10,000 in view of easy control of the plasticity of the component.

The amorphous polyester segment may be prepared through any known process. For example, the amorphous polyester segment can be prepared through polycondensation (esterification) between the aforementioned polyvalent carboxylic acid and polyhydric alcohol in the presence of any known esterification catalyst.

(Esterification Catalyst)

Examples of the known esterification catalyst include compounds of alkali metals, such as sodium and lithium; compounds containing group 2 elements, such as magnesium and calcium; compounds of metals, such as aluminum, zinc, manganese, antimony, titanium, tin, zirconium, and germanium; phosphite compounds; phosphate compounds; and amine compounds. Specific examples of the tin compound include dibutyltin oxide, tin octylate, tin dioctylate, and salts thereof. Examples of the titanium compound include titanium alkoxides, such as tetra-n-butyl titanate, tetraisopropyl titanate, tetramethyl titanate, and tetrastearyl titanate; titanium acylates, such as polyhydroxytitanium stearate; and titanium chelate compounds, such as titanium tetraacetylacetonate, titanium lactate, and titanium triethanolaminate. Examples of the germanium compound include germanium dioxide. Examples of the aluminum compounds include oxides, such as poly(aluminum hydroxide); aluminum alkoxides; and tributyl aluminate. These compounds may be used alone or in combination.

(Styrene-Acrylic Polymer Segment)

The styrene-acrylic polymer segment is composed of an aromatic vinyl monomer, a (meth)acrylate monomer, and a bireactive monomer.

The aromatic vinyl monomer may be any of those described above in the section <styrene-acrylic resin>.

These aromatic vinyl monomers may be used alone or in combination.

The (meth)acrylate monomer may be any of those described above in the section <styrene-acrylic resin>. These (meth)acrylate monomers may be used alone or in combination.

The aromatic vinyl monomer or (meth)acrylate monomer used for forming the styrene-acrylic polymer segment is preferably styrene or its derivative in view of achievement of superior charging properties and high image quality. In detail, the amount of styrene or its derivative is preferably 50 mass % or more relative to the total amount of the monomers (aromatic vinyl monomer and (meth)acrylate monomer) used for forming the styrene-acrylic polymer segment.

The bireactive monomer may be of any type having a polymerizable unsaturated group and a group that can react with the polyvalent carboxylic acid monomer and/or the polyhydric alcohol monomer for forming the amorphous polyester segment. Specific examples of the bireactive monomer include acrylic acid, methacrylic acid, fumaric acid, maleic acid, and maleic anhydride. In the present invention, the bireactive monomer is preferably acrylic acid or methacrylic acid.

(Resin Usable in Combination with Styrene-Acrylic Modified Polyester Resin)

If the amorphous resin A or the amorphous resin B is a styrene-acrylic modified polyester resin, an additional resin may be used in combination with the styrene-acrylic modified polyester resin so long as the advantageous effects of the present invention are not inhibited. Examples of the additional resin include styrene-acrylic resins, polyester resins, and urethane resins.

The amount of the styrene-acrylic modified polyester resin contained in the shell is preferably 70 to 100 mass %, more preferably 90 to 100 mass %, relative to the total amount (100 mass %) of the resins forming the shell.

A styrene-acrylic modified polyester resin content of the shell of 70 mass % or more leads to sufficient compatibility between the core particle and the shell. This configuration contributes to formation of a desired shell and prevents unsatisfactory thermal resistance during storage, charging properties, and fracture resistance.

(Styrene-Acrylic Content)

If the amorphous resin B is a styrene-acrylic modified polyester resin and the amorphous resin A is a styrene-acrylic resin or the amorphous resin A is a styrene-acrylic modified polyester resin and the amorphous resin B is a styrene-acrylic resin, the amount of the styrene-acrylic polymer segment contained in the styrene-acrylic modified polyester resin (as used herein, the amount refers to as "styrene-acrylic content") is preferably 5 to 30 mass %, more preferably 10 to 25 mass %. A styrene-acrylic content falling within the above range leads to high compatibility of the styrene-acrylic modified polyester resin with the styrene-acrylic resin contained in the core particle, resulting in improved releasability of the core-shell toner during fixation, and high toner retention after fixation.

In specific, the styrene-acrylic content corresponds to the proportion of the total mass of the aromatic vinyl monomer and the (meth)acrylate monomer to the total mass of the materials used for the synthesis of the styrene-acrylic modified polyester resin; i.e., the total mass of the monomer for the unmodified polyester resin (to form the amorphous polyester segment), the aromatic vinyl monomer and (meth) acrylate monomer for the styrene-acrylic polymer segment, and the bireactive monomer for bonding these segments.

A styrene-acrylic content falling within the above range leads to appropriate control of the compatibility between the styrene-acrylic modified polyester resin and the styrene-acrylic resin. This contributes to appropriate balance between the following two types of fusions; i.e., the fusion of the interface between the styrene-acrylic modified polyester resin and the styrene-acrylic resin, and the fusion of the styrene-acrylic modified polyester resin.

If the amorphous resin B is a styrene-acrylic modified polyester resin and the amorphous resin A is a styrene-acrylic resin, the resultant shell coat or coat domain exhibits superior thermal resistance and fixing properties, and the toner matrix particles have smooth surfaces. A styrene-acrylic content of 5 mass % or more leads to appropriate formation of the shell membrane or membranous domain, resulting in sufficient fusion of the interface between the styrene-acrylic modified polyester resin and the core particle. This prevents insufficient fusion of the toner during fixation. Thus, the styrene-acrylic content is preferably 5 mass % or more in view of satisfactory low-temperature fixing properties and document offset resistance. The styrene-acrylic content is also preferably 30 mass % or less in view of prevention of an excessive increase in the softening point of the styrene-acrylic modified polyester resin and achievement of satisfactory low-temperature fixing properties of the toner particles.

(Bonding Between Styrene-Acrylic Polymer Segment and Polyester Segment)

The styrene-acrylic polymer segment may be bonded to the end of the polyester main chain, or may be in the form of a side chain grafted to the polyester main chain. The styrene-acrylic modified polyester resin prepared through bonding of the styrene-acrylic polymer segment to the end of the polyester resin chain is likely to form domains of the polyester segment and the styrene-acrylic polymer segment. Thus, the amorphous polyester segment is readily oriented to the toner surface layer during the coagulation—fusion process, and the styrene-acrylic polymer segment is readily oriented to the toner surface layer in the case where the core particle contains the styrene-acrylic resin, resulting in formation of a dense core-shell structure.

(Preparation of Styrene-Acrylic Modified Polyester Resin)

The styrene-acrylic modified polyester resin may be prepared by any common process. Among the following four typical processes, process (A) is most preferred.

(A) Process involving preliminary polymerization of an amorphous polyester segment, reaction of the amorphous polyester segment with a bireactive monomer, and reaction of the resultant product with an aromatic vinyl monomer and a (meth)acrylate monomer for formation of a styrene-acrylic polymer segment.

(B) Process involving preliminary polymerization of a styrene-acrylic polymer segment, reaction of the styrene-acrylic polymer segment with a bireactive monomer, and reaction of the resultant product with a polyvalent carboxylic acid monomer and a polyhydric alcohol monomer for formation of an amorphous polyester segment.

(C) Process involving preliminary polymerization of an amorphous polyester segment and a styrene-acrylic polymer segment, and bonding of these segments through reaction of the segments with a bireactive monomer.

(D) Process involving preliminary polymerization of an amorphous polyester segment, and addition polymerization of a styrene-acrylic polymerizable monomer with a polymerizable unsaturated group of the amorphous polyester segment for bonding of the monomer and the segment.

In specific, process (A) involves, for example, the following steps:

(1) mixing of an unmodified polyester resin with an aromatic vinyl monomer, a (meth)acrylate monomer, and a bireactive monomer; and (2) polymerization of the aromatic vinyl monomer and the (meth)acrylate monomer.

This process can bond an amorphous polyester segment to a styrene-acrylic polymer segment.

Through the mixing Step (1) and the polymerization Step (2), the hydroxy group at the end of the amorphous polyester segment forms an ester bond with the carboxy group of the bireactive monomer, and the vinyl group of the bireactive monomer is bonded to the vinyl group of the aromatic vinyl monomer or the (meth)acrylic monomer to form a styrene-acrylic polymer segment.

The mixing Step (1) preferably involves heating. The heating temperature may be any temperature that allows for the mixing of the unmodified polyester resin, the aromatic vinyl monomer, the (meth)acrylate monomer, and the bireactive monomer. The heating temperature is preferably 80 to 120° C., more preferably 85 to 115° C., still more preferably 90 to 110° C., in view of effective mixing and easy control of polymerization.

The total amount of the aromatic vinyl monomer and the (meth)acrylate monomer is preferably 5 to 30 mass %, particularly preferably 5 to 20 mass %, relative to the total amount (100 mass %) of the resin materials used for the preparation of the styrene-acrylic modified polyester resin; i.e., the total amount of the unmodified polyester resin, the aromatic vinyl monomer, the (meth)acrylate monomer, and the bireactive monomer.

It is preferred that the proportion of the total mass of the aromatic vinyl monomer and the (meth)acrylate monomer to the total mass of the resin materials falls within the above range. A proportion falling within the range leads to appropriate control of the compatibility between the styrene-acrylic modified polyester resin and the core particle and formation of a desired shell, resulting in improved releasability of the toner during fixation, and high toner retention after fixation.

A proportion of 5 mass % or more leads to formation of a desired shell from the styrene-acrylic modified polyester resin and prevention of excessive exposure of the core particle, resulting in sufficient thermal resistance during storage and charging properties of the toner.

A proportion of 30 mass % or less leads to prevention of an excessive increase in the softening point of the styrene-acrylic modified polyester resin, resulting in satisfactory low-temperature fixing properties of the toner.

The amount of the bireactive monomer is preferably 0.1 to 10.0 mass %, particularly preferably 0.5 to 3.0 mass %, relative to the total amount (100 mass %) of the resin materials used for the preparation of the styrene-acrylic modified polyester resin; i.e., the total amount of the unmodified polyester resin, the aromatic vinyl monomer, the (meth)acrylate monomer, and the bireactive monomer.

[Crystalline Material]

The core particle according to the present invention contains a crystalline material.

The crystalline material exhibits a clear endothermic peak, rather than a stepwise endothermic change, in differential scanning calorimetry (DSC) of the toner. The clear endothermic peak has a half width of 15° C. or less as determined by DSC described in Examples at a heating rate of 10° C./min.

Specific examples of the crystalline material include crystalline polyester resins, and release agents, such as waxes.

The crystalline material according to the present invention preferably includes a crystalline resin or a release agent selected from a hydrocarbon wax and an ester wax, and the crystalline material preferably has a melting point ($T_{m-c}$) equal to or higher than (the glass transition temperature ($T_{g-b}$) of the amorphous resin B+3)° C., in view of a further improvement in thermal resistance during storage and transfer efficiency. If the crystalline material has a melting point ($T_{m-c}$) equal to or higher than (the glass transition temperature ($T_{g-b}$) of the amorphous resin B+3)° C., coalescence and enlargement of crystalline material grains is prevented during addition of the amorphous resin B or coagulation of the core particle with the shell particle, leading to avoidance of bleeding out of the crystalline material to the surface layer of the core particle. As a result, low thermal resistance during storage and low transfer efficiency of the toner can be prevented.

The crystalline material has a melting point ($T_{m-c}$) of preferably 66 to 85° C., more preferably 68 to 78° C. A melting point ($T_{m-c}$) falling within this range probably contributes to high compatibility between thermal resistance and plasticity/releasability during fixation.

The crystalline resin may be of any type, such as a crystalline polyester resin.

<Crystalline Polyester Resin>

The crystalline polyester resin is derived from any known polyester resin prepared through polycondensation between a di- or higher-valent carboxylic acid (polyvalent carboxylic acid) and a di- or higher-valent alcohol (polyhydric alcohol). As described above, the crystalline polyester resin exhibits a clear endothermic peak, rather than a stepwise endothermic change, by differential scanning calorimetry (DSC) of the toner.

The crystalline polyester resin preferably satisfies Expression (A):

$$5 \leq |C_{acid} - C_{alcohol}| \leq 12 \quad \text{Expression (A):}$$

where $C_{alcohol}$ represents the number of carbon atoms of the main chain of a structural unit derived from a polyhydric alcohol forming the crystalline polyester resin and $C_{acid}$ represents the number of carbon atoms of the main chain of a structural unit derived from a polyvalent carboxylic acid forming the crystalline polyester resin.

Each toner matrix particle includes a crystalline polyester resin having alkyl chains of different lengths that are repeated via ester bonds. This configuration prevents coagulation of grains of the crystalline polyester resin and thus formation of large crystal domains of the crystalline polyester resin even in high-temperature environments. Thus, the toner maintains fixing properties even after being stored at high temperatures.

From the viewpoint of effective achievement of similar advantageous effects, the crystalline polyester resin preferably satisfies Expression (B):

$$6 \leq |C_{acid} - C_{alcohol}| \leq 10. \quad \text{Expression(B):}$$

From the viewpoint of an improvement in fixing properties, the crystalline polyester resin preferably satisfies Expression (C):

$$C_{alcohol}<C_{acid} \quad \text{Expression (C):}$$

From the viewpoint of an improvement in fixing properties, the number of carbon atoms of the main chain of the structural unit derived from the polyhydric alcohol forming the crystalline polyester resin (i.e., $C_{alcohol}$) is preferably 2 to 12, and the number of carbon atoms of the main chain of the structural unit derived from the polyvalent carboxylic acid forming the crystalline polyester resin (i.e., $C_{acid}$) is preferably 6 to 16.

The crystalline polyester resin satisfying the aforementioned definitions may be in any form.

A dicarboxylic acid component is used as the polyvalent carboxylic acid component. The dicarboxylic acid component is preferably an aliphatic dicarboxylic acid, and may be used in combination with an aromatic dicarboxylic acid. The aliphatic dicarboxylic acid is preferably a linear-chain aliphatic dicarboxylic acid. The use of a linear-chain aliphatic dicarboxylic acid is advantageous in view of an improvement in crystallinity. Two or more dicarboxylic acid components may be used in combination.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, and 1,18-octadecanedicarboxylic acid. Lower alkyl esters and anhydrides of these acids may also be used.

Among the aforementioned aliphatic dicarboxylic acids, preferred are aliphatic dicarboxylic acids having 6 to 14 carbon atoms in view of the advantageous effects of the present invention.

Examples of the aromatic dicarboxylic acid that can be used in combination with the aliphatic dicarboxylic acid include terephthalic acid, isophthalic acid, o-phthalic acid, t-butylisophthalic acid, 2,6-naphthalenedicarboxylic acid, and 4,4'-biphenyldicarboxylic acid. Among these acids, preferred are terephthalic acid, isophthalic acid, and t-butylisophthalic acid, which can be readily available and emulsified.

The dicarboxylic acid component of the crystalline polyester resin contains an aliphatic dicarboxylic acid in an amount of preferably 50 mol % or more, more preferably 70 mol % or more, still more preferably 80 mol % or more, particularly preferably 100 mol %. An aliphatic dicarboxylic acid content of the dicarboxylic acid component of 50 mol % or more leads to sufficient crystallinity of the crystalline polyester resin.

A diol component is used as the polyhydric alcohol component. The diol component is preferably an aliphatic diol. The diol component may optionally contain any diol other than an aliphatic diol. The aliphatic diol is preferably a linear-chain aliphatic diol. The use of a linear-chain aliphatic diol is advantageous in view of an improvement in crystallinity. Two or more diol components may be used in combination.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecandiol, and 1,20-eicosanediol.

Among the aforementioned aliphatic diols, preferred are aliphatic diols having 2 to 12 carbon atoms in view of the advantageous effects of the present invention. More preferred are aliphatic diols having 4 to 12 carbon atoms.

Examples of the optional diol other than the aliphatic diol include diols having a double bond, diols having a sulfonate group, and diols having a bisphenol structure. Specific examples of the diols having a double bond include 2-butene-1,4-diol, 3-butene-1,6-diol, and 4-butene-1,8-diol.

The diol component of the crystalline polyester resin contains an aliphatic diol in an amount of preferably 50 mol % or more, more preferably 70 mol % or more, still more preferably 80 mol % or more, particularly preferably 100 mol %. An aliphatic diol content of the diol component of 50 mol % or more leads to sufficient crystallinity of the crystalline polyester resin, resulting in superior low-temperature fixing properties of the resultant toner, and glossy images provided by the toner.

The stoichiometric ratio of the hydroxy group [OH] of the diol component to the carboxy group [COOH] of the dicarboxylic acid component ([OH]/[COOH]) is preferably 2.0/1.0 to 1.0/2.0, more preferably 1.5/1.0 to 1.0/1.5, particularly preferably 1.3/1.0 to 1.0/1.3.

The crystalline polyester resin may be prepared through any known process. For example, the crystalline polyester resin can be prepared through polycondensation (esterification) between the aforementioned polyvalent carboxylic acid and polyhydric alcohol in the presence of any known esterification catalyst.

The polymerization may be performed at any temperature. The polymerization temperature is preferably 150 to 250° C. The polymerization may be performed for any period of time. The polymerization time is preferably 0.5 to 10 hours. The polymerization may optionally be performed in a reaction system at reduced pressure.

If the crystalline polyester resin satisfies the aforementioned definitions, the crystalline polyester resin may be derived from any crystalline polyester resin or may include a hybrid crystalline polyester resin described below. The hybrid crystalline polyester resin will now be briefly described.

<Hybrid Crystalline Polyester Resin>

The hybrid crystalline polyester resin is a chemically bonded composite of a crystalline polyester resin segment and an amorphous resin segment other than the polyester resin.

The crystalline polyester resin segment is derived from any crystalline polyester resin. Thus, the crystalline polyester resin segment refers to a molecular chain having the same chemical structure as the crystalline polyester resin. The amorphous resin segment other than the polyester resin is derived from any amorphous resin other than the polyester resin. Thus, the amorphous resin segment refers to a molecular chain having the same chemical structure as the amorphous resin other than the polyester resin.

(Crystalline Polyester Resin Segment)

The crystalline polyester resin segment is derived from the aforementioned crystalline polyester resin, and exhibits a clear endothermic peak, rather than a stepwise endothermic change, by differential scanning calorimetry (DSC) of the toner.

The crystalline polyester resin segment satisfying the aforementioned definitions may be in any form. For example, the following copolymer resins correspond to the hybrid crystalline polyester resin according to the present invention: a resin composed of a crystalline polyester resin segment having a main chain copolymerized with any other component and a resin composed of a crystalline polyester resin segment copolymerized with the main chain of any other component, with the proviso that the toner containing such a copolymer resin exhibits the aforementioned clear endothermic peak.

The crystalline polyester resin segment may be prepared through any known process. For example, the segment can be prepared through polycondensation (esterification) between the aforementioned polyvalent carboxylic acid and polyhydric alcohol in the presence of any known esterification catalyst.

The crystalline polyester resin segment is preferably prepared through polycondensation of the aforementioned polyvalent carboxylic acid and polyhydric alcohol and a compound that chemically bonds to the amorphous resin segment.

The hybrid crystalline polyester resin contains the aforementioned crystalline polyester resin segment and the below-described amorphous resin segment other than polyester resin.

(Amorphous Resin Segment Other than Polyester Resin)

The amorphous resin segment other than the polyester resin (hereinafter may be referred to simply as "amorphous resin segment") is a segment for controlling the compatibility between the amorphous resin and the hybrid crystalline polyester resin. The presence of the amorphous resin segment can improve the compatibility between the hybrid crystalline polyester resin and the amorphous resin to facilitate merging of the hybrid crystalline polyester resin into the amorphous resin, resulting in improved charging uniformity.

The amorphous resin segment is derived from an amorphous resin other than the crystalline polyester resin. The amorphous resin segment contained in the hybrid crystalline polyester resin (and in the toner) can be confirmed through identification of the chemical structure by, for example, NMR or methylation P-GC/MS.

The results of differential scanning calorimetry (DSC) performed on a resin having the same chemical structure and molecular weight as those of the amorphous resin segment show that the resin has no melting point but has a relatively high glass transition temperature ($T_g$). In the DSC of the resin having the same chemical structure and same molecular weight as those of the amorphous resin segment, the glass transition temperature ($T_{g1}$) in the first heating process is preferably 30 to 80° C., particularly preferably 40 to 65° C.

The amorphous resin segment satisfying the aforementioned definitions may be in any form. For example, the following copolymer resins correspond to the hybrid crystalline polyester resin containing the amorphous resin segment according to the present invention: a resin composed of an amorphous resin segment having a main chain copolymerized with any other component and a resin composed of an amorphous resin segment copolymerized with the main chain of any other component, with the proviso that the toner containing such a copolymer has the aforementioned amorphous resin segment.

The amorphous resin segment is preferably composed of a resin similar to the amorphous resin A. Such an amorphous resin segment significantly enhances the compatibility between the hybrid crystalline polyester resin and the amorphous resin. Thus, the hybrid crystalline polyester resin is more readily incorporated into the amorphous resin, resulting in further improved charging uniformity.

The amorphous resin segment may be composed of any resin component. Examples of the resin component include vinyl resins, urethane resins, and urea resins. Among these resins, preferred are vinyl resins in view of easy control of thermoplastic characteristics.

The vinyl resin may be of any type that is prepared through polymerization of a vinyl compound. Examples of the vinyl resin include acrylate resins, styrene-acrylate resins, and ethylene-vinyl acetate resins. These vinyl resins may be used alone or in combination.

Among these vinyl resins, preferred are styrene-acrylate resins (styrene-acrylic resins) in view of plasticity during thermal fixation. Thus, the styrene-acrylic polymer segment serving as the amorphous resin segment will be described below.

The styrene-acrylic polymer segment is prepared through addition polymerization of at least a styrene monomer and a (meth)acrylate monomer. As used herein, the "styrene monomer" includes styrene, which is represented by the formula $CH_2{=}CH{-}C_6H_5$, and styrene derivatives having known side chains or functional groups in the styrene structure. As used herein, the "(meth)acrylate monomer" includes acrylate and methacrylate compounds represented by the formula $CH_2{=}CHCOOR$ (where R is an alkyl group), and ester compounds having known side chains or functional groups in the structure of acrylate or methacrylate derivatives.

Preferred examples of the styrene monomers and the (meth)acrylate monomers that can form the styrene-acrylic copolymer segment include aromatic vinyl monomers and (meth)acrylate monomers described in the section <styrene-acrylic resin>. Other styrene monomers and (meth)acrylate monomers may be used in the present invention for formation of the styrene-acrylic copolymer segment.

The content of the amorphous resin segment is preferably 2 to 20 mass %, more preferably 4 to 15 mass %, still more preferably 5 to 11 mass %, relative to the entire amount of the hybrid crystalline polyester resin. A content of the amorphous resin segment within the above range leads to sufficient crystallinity of the hybrid crystalline polyester resin.

(Preparation of Hybrid Crystalline Polyester Resin)

The hybrid resin according to the present invention may be prepared by any process that can produce a polymer having a structure composed of the crystalline polyester resin segment and the amorphous resin segment molecularly bonded thereto. For example, the hybrid resin may be prepared in the same manner as described above in the section <preparation of styrene-acrylic modified polyester resin> except that the amorphous polyester segment is replaced with the crystalline polyester resin segment. In this case, the styrene-acrylic polymer segment may be replaced with another amorphous resin segment.

<Release Agent (Wax)>

Any known release agent may be used in the present invention. Examples of the release agent include polyolefin waxes, such as polyethylene wax and polypropylene wax; branched-chain hydrocarbon waxes, such as microcrystalline wax; hydrocarbon waxes, such as paraffin wax and Sasolwax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate; and amide waxes, such as ethylenediaminebehenylamide and trimellitic acid tristearylamide. These release agents may be used alone or in combination.

The release agent has a melting point of preferably 40 to 160° C., more preferably 50 to 120° C., still more preferably 60 to 90° C. A melting point of the release agent within the above range leads to sufficient thermal resistance during storage of the toner. In addition, toner images can be reliably formed during fixation at a low temperature without causing cold offset. The release agent content of the toner is preferably 1 to 30 mass %, more preferably 5 to 20 mass %.

<Colorant>

The colorant according to the present invention may be of any type, such as carbon black, a magnetic material, a dye, or a pigment. Examples of the carbon black include channel black, furnace black, acetylene black, thermal black, and lamp black. Examples of the magnetic material include ferromagnetic metals, such as iron, nickel, and cobalt; alloys of these metals; ferromagnetic metal compounds, such as ferrite and magnetite; alloys containing no ferromagnetic metal and exhibiting ferromagnetism through thermal treatment, such as Heusler alloys (e.g., manganese-copper-aluminum and manganese-copper-tin); and chromium dioxide.

Examples of the black colorant include carbon black materials, such as furnace black, channel black, acetylene black, thermal black, and lamp black; and powdery magnetic materials, such as magnetite and ferrite.

Examples of the magenta or red colorant include C. I. Pigment Reds 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269.

Examples of the orange or yellow colorant include C. I. Pigment Oranges 31 and 43, and C. I. Pigment Yellows 12, 14, 15, 17, 74, 83, 93, 94, 138, 155, 162, 180, and 185.

Examples of the green or cyan colorant include C. I. Pigment Blues 2, 3, 15, 15:2, 15:3, 15:4, 16, 17, 60, 62, and 66, and C. I. Pigment Green 7.

These colorants may be used alone or in combination.

The content of the colorant is preferably 1 to 30 mass %, more preferably 2 to 20 mass %, relative to the entire amount of the toner. The toner may contain any mixture of the aforementioned colorants. A content of the colorant within such a range leads to satisfactory color reproduction of images.

The colorant has a volume average particle size of 10 to 1,000 nm, preferably 50 to 500 nm, more preferably 80 to 300 nm.

[Additional Component]

The toner matrix particles according to the present invention may optionally contain an internal additive (e.g., a charge controlling agent) or an external additive (e.g., inorganic microparticles, organic microparticles, or a lubricant) in addition to the aforementioned components.

<Charge Controlling Agent>

The charge controlling agent may be any known compound. Examples of such a compound include nigrosine dyes, metal salts of naphthenic acid and higher fatty acids, alkoxylated amines, quaternary ammonium salts, azo-metal complexes, and salicylic acid metal salts.

The content of the charge controlling agent is typically 0.1 to 10 mass %, preferably 0.5 to 5 mass %, relative to the entire amount (100 mass %) of the binder resin contained in the resultant toner matrix particles.

The charge controlling agent has a number average primary particle size of, for example, 10 to 1,000 nm, preferably 50 to 500 nm, more preferably 80 to 300 nm.

(External Additive)

The toner may contain any known external additive in view of improvements in charging properties, fluidity, and cleanability. Examples of the additive include inorganic microparticles, organic microparticles, and lubricants. Such an external additive may be deposited onto the surfaces of the toner matrix particles.

The inorganic microparticles are preferably composed of, for example, silica, titania, alumina, or strontium titanate.

The inorganic microparticles may optionally be subjected to hydrophobic treatment.

The organic microparticles may be spherical organic microparticles having a number average primary particle size of about 10 to 2,000 nm. In detail, the organic microparticles may be composed of a homopolymer of styrene or methyl methacrylate or a copolymer of these monomers.

The lubricant is used for further improving the cleanability and transfer efficiency of the toner. Examples of the lubricant include metal salts of higher fatty acids, such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be used in combination.

The content of the external additive is preferably 0.1 to 10.0 mass % relative to the entire amount (100 mass %) of the toner matrix particles.

The external additive may be mixed with the toner matrix particles with any known mixer, such as a Turbula mixer, a Henschel mixer, a Nauta mixer, or a V-type mixer.

<<Steps I to III>>

Now will be described Steps I to III of the method of producing a toner for developing electrostatic images of the present invention. In the embodiment described below, Step III is followed by additional steps; i.e., a heating-cooling step and a separation-drying step. The method of the present invention may include other additional steps.

[Step I]

Step I involves dispersing at least the amorphous resin A and the crystalline material in an aqueous medium to prepare a dispersion, and adjusting the temperature of the dispersion to be equal to or higher than (the glass transition temperature ($T_{g-a}$) of the amorphous resin A+10)° C. and equal to or lower than (the melting point ($T_{m-c}$) of the crystalline material+10)° C., to prepare a core particle dispersion through coagulation and coalescence of at least the amorphous resin A and the crystalline material.

The temperature of the dispersion containing the amorphous resin A and the crystalline material is preferably adjusted to be equal to or higher than (the glass transition temperature ($T_{g-a}$) of the amorphous resin A+15)° C. and equal to or lower than (the melting point ($T_{m-c}$) of the crystalline material+8)° C., more preferably a temperature equal to or higher than ($T_{g-a}$+20)° C. and equal to or lower than ($T_{m-c}$)+7)° C.

A temperature adjusted to be equal to or higher than (the glass transition temperature ($T_{g-a}$) of the amorphous resin A+15)° C. leads to a decrease in viscosity of the amorphous resin A (i.e., activation of molecular motion), resulting in a reduced number of irregularities of core particles. A temperature adjusted to be equal to or lower than (the melting point ($T_{m-c}$) of the crystalline material+8)° C. prevents excessive mixing of the crystalline material, resulting in satisfactory releasability and plasticity. This adjustment also contributes to improvements in dispersion of a colorant, the charging properties of the toner, and the quality of images.

The dispersion containing the amorphous resin A and the crystalline material is preferably prepared through mixing of a dispersion containing particles of the amorphous resin A (hereinafter may be referred to as "amorphous resin A particle dispersion"), a dispersion of the crystalline material (e.g., release agent or crystalline resin), and a dispersion of the colorant in an aqueous medium.

The coagulation and coalescence process preferably involves addition of a coagulant to the dispersion containing the amorphous resin A and the crystalline material. If the crystalline material is the crystalline polyester resin, the addition of the crystalline polyester resin is preferably preceded by the addition of the coagulant.

If the amorphous resin A contains a release agent as the crystalline material, the mixing of the crystalline material dispersion may be omitted.

For incorporation of an internal additive (e.g., a release agent) into the toner matrix particles, the internal additive may be incorporated in the amorphous resin A particles. Alternatively, a dispersion of internal additive microparticles may be separately prepared, and the dispersion may be added before or after the addition of the coagulant. In the case of incorporation of the crystalline polyester resin, the internal additive microparticle dispersion is preferably added before completion of the addition of the crystalline polyester resin.

Now will be described the preparation of an amorphous resin A particle dispersion, a colorant dispersion, and a crystalline material dispersion.

In the following description, the amorphous resin A is a styrene-acrylic resin, and the crystalline material is a release agent.

(Preparation of Styrene-Acrylic Resin Particle Dispersion)

The styrene-acrylic resin (amorphous resin A) particle dispersion is prepared through synthesis of a styrene-acrylic resin and then dispersion of the styrene-acrylic resin in the form of microparticles in an aqueous medium.

As described above, the styrene-acrylic resin may be synthesized by any known emulsion polymerization process. For incorporation of a release agent into styrene-acrylic resin particles, the release agent is added during the polymerization of the styrene-acrylic resin. In this case, the styrene-acrylic resin is preferably prepared by a miniemulsion polymerization process.

The styrene-acrylic resin is dispersed in an aqueous medium by, for example, process (i) or (ii) described below. Process (i) involves formation of styrene-acrylic resin particles from a monomer for the styrene-acrylic resin, and preparation of an aqueous dispersion of the styrene-acrylic resin particles. Process (ii) involves dissolution or dispersion of the styrene-acrylic resin in an organic solvent to prepare an oil-phase solution, dispersion of the oil-phase solution in an aqueous medium through phase inversion emulsification to form oil droplets having a desired size, and removal of the organic solvent.

As used herein, the term "aqueous medium" refers to a medium containing water in an amount of 50 mass % or more. Examples of the component of the aqueous medium other than water include organic solvents miscible with water, such as methanol, ethanol, 2-propanol, butanol, acetone, methyl ethyl ketone, dimethylformamide, methyl cellosolve, and tetrahydrofuran. Among these organic compounds, preferred are alcohol solvents, such as methanol, ethanol, 2-propanol, and butanol, which cannot dissolve the resin. The aqueous medium preferably consists of water (e.g., deionized water).

Process (i) preferably involves addition of a monomer for the styrene-acrylic resin to an aqueous medium together with a polymerization initiator to prepare base particles through polymerization, and then addition of a radically polymerizable monomer for the styrene-acrylic resin and a polymerization initiator to a dispersion of the base particles for seed polymerization of the monomer with the base particles.

The polymerization initiator may be a water-soluble polymerization initiator. Preferred examples of the water-soluble polymerization initiator include water-soluble radical polymerization initiators, such as potassium persulfate and ammonium persulfate.

The seed polymerization system for preparation of the styrene-acrylic resin particles may involve the use of the aforementioned chain transfer agent for controlling the molecular weight of the styrene-acrylic resin. The chain transfer agent is preferably mixed with the resin materials in the aforementioned mixing step.

Process (ii) preferably involves the use of an organic solvent having a low boiling point and low solubility in water for preparation of the oil-phase solution in view of easy removal of the solvent after formation of oil droplets. Specific examples of the organic solvent include methyl acetate, ethyl acetate, methyl ethyl ketone, isopropyl alcohol, methyl isobutyl ketone, toluene, and xylene. These organic solvents may be used alone or in combination.

The amount of an organic solvent (or the total amount of two or more organic solvents) is typically 10 to 500 parts by mass, preferably 100 to 450 parts by mass, more preferably 200 to 400 parts by mass, relative to 100 parts by mass of the styrene-acrylic resin.

The amount of the aqueous medium is preferably 50 to 2,000 parts by mass, more preferably 100 to 1,000 parts by mass, relative to 100 parts by mass of the oil-phase solution. An amount within the above range leads to formation of oil droplets having a desired size through effective emulsification and dispersion of the oil-phase solution in the aqueous medium.

The aqueous medium may contain a dispersion stabilizer. Alternatively, the aqueous medium may contain a surfactant or a microparticulate resin for improving the dispersion stability of oil droplets.

The dispersion stabilizer may be of any known type. The dispersion stabilizer is preferably of an acid- or alkali-soluble type, such as tricalcium phosphate, or an enzyme-degradable type from the environmental viewpoint.

Examples of the surfactant include known anionic surfactants, cationic surfactants, nonionic surfactants, and amphoteric surfactants.

Examples of the microparticulate resin for improving the dispersion stability include microparticulate poly(methyl methacrylate) resins, microparticulate polystyrene resins, and microparticulate poly(styrene-acrylonitrile) resins.

The oil-phase solution can be emulsified by use of mechanical energy with any disperser. Examples of the disperser include homogenizers, low-rate shearing dispersers, high-rate shearing dispersers, frictional dispersers, high-pressure jet dispersers, ultrasonic dispersers, and high-pressure impact dispersers (e.g., Ultimizer).

After the formation of the oil droplets, the entire dispersion of the styrene-acrylic resin particles in the aqueous medium is gradually heated under agitation and then maintained at a predetermined temperature under vigorous agitation, followed by removal of the organic solvent. The organic solvent may be removed with, for example, an evaporator at reduced pressure.

The styrene-acrylic resin particles (oil droplets) in the styrene-acrylic resin particle dispersion prepared by process (i) or (ii) have a volume median particle size of preferably 60 to 1,000 nm, more preferably 80 to 500 nm. The volume median particle size of the oil droplets can be adjusted by, for example, control of the mechanical energy during emulsification and dispersion.

The content of the styrene-acrylic resin particles in the styrene-acrylic resin particle dispersion is preferably 5 to 50 mass %, more preferably 10 to 30 mass %. A content of the styrene-acrylic resin particles within the above range leads to a narrow particles size distribution and an improvement in properties of the toner.

(Preparation of Colorant Dispersion)

The colorant dispersion is prepared through dispersion of a colorant in the form of microparticles in an aqueous medium.

The aqueous medium is as described above in the section "preparation of styrene-acrylic resin particle dispersion." The aqueous medium may contain a surfactant or resin microparticles for improving the dispersion stability of the colorant.

The colorant may be dispersed in the aqueous medium by mechanical energy with any disperser. The disperser may be the same as described above in the section "preparation of styrene-acrylic resin particle dispersion."

The content of the colorant microparticles in the colorant dispersion is preferably 10 to 50 mass %, more preferably 15 to 40 mass %. A content of the colorant microparticles within the above range leads to satisfactory color reproduction of images.

(Preparation of Release Agent Dispersion)

The release agent (crystalline material) dispersion is prepared through dispersion of a release agent in the form of microparticles in an aqueous medium.

The aqueous medium is as described above in the section "preparation of styrene-acrylic resin particle dispersion." The aqueous medium may contain a surfactant or resin microparticles for improving the dispersion stability of the release agent.

The release agent may be dispersed in the aqueous medium by mechanical energy with any disperser. The disperser may be the same as described above in the section "preparation of styrene-acrylic resin particle dispersion."

The content of the release agent microparticles in the release agent dispersion is preferably 10 to 50 mass %, more preferably 15 to 40 mass %. A content of the release agent microparticles within the above range leads to satisfactory hot offset resistance and releasability of the toner.

(Coagulant)

The coagulant may be of any type and is preferably selected from metal salts. Examples of the metal salts include salts of monovalent metals, such as alkali metals (e.g., sodium, potassium, and lithium); and salts of divalent metals (e.g., calcium, magnesium, manganese, and copper); and salts of trivalent metals (e.g., iron and aluminum). Specific examples of the metal salts include sodium chloride, potassium chloride, lithium chloride, calcium chloride, magnesium chloride, zinc chloride, copper sulfate, magnesium sulfate, and manganese sulfate. Among these, divalent metal salts are particularly preferred. The use of a small amount of such a divalent metal salt can promote coagulation. These coagulants may be used alone or in combination.

After addition of the coagulant in Step I, the resultant mixture is preferably allowed to stand for only a short period of time until the start of heating. Preferably, the mixture is heated to a temperature equal to or higher than (the glass transition temperature ($T_{g\text{-}a}$) of the amorphous resin A+10)° C. and equal to or lower than (the melting point ($T_{m\text{-}c}$) of the crystalline material+10)° C. immediately after the addition of the coagulant. If the mixture is allowed to stand for a long period of time before the heating, resin particles may fail to be uniformly coagulated, leading to a variation in particle size distribution of the toner matrix particles, and inconsistent surface properties of the toner matrix particles. The mixture is allowed to stand before the heating for typically 30 minutes or less, preferably 10 minutes or less. The coagulant is preferably added at a temperature equal to or lower than the glass transition temperature of the amorphous resin, more preferably at room temperature.

The heating rate in Step I is preferably 0.8° C./min or more. The upper limit of the heating rate may be any value, and is preferably 15° C./min for avoiding formation of coarse particles due to rapid fusion. This heating promotes coagulation of microparticles of the amorphous resin A and the colorant, to form coagulated particles.

The coagulation and coalescence is preferably performed at an appropriately controlled agitation rate. The control of the agitation rate can reduce the collision and repulsion between particles, to promote contact between the particles and coagulation of the particles. The temperature of the mixture is preferably higher than the melting point of the crystalline resin. While the temperature of the mixture is maintained, the agitation rate is appropriately controlled (e.g., the agitation rate is lowered) to promote coagulation of the styrene-acrylic resin particles and the colorant microparticles. After the particle size of the coagulated particles reaches a desired value, the mixture is cooled in Step II described below, and the coagulation is then stopped through addition of a coagulation stopper, such as an aqueous solution of salts, such as sodium chloride. The resultant coagulated particles preferably have a volume median particle size of 4.5 to 7.0 μm. The volume median particle size of the coagulated particles can be determined with an analyzer "Coulter Multisizer 3" (manufactured by Beckman Coulter, Inc.).

<Crystalline Polyester Resin Dispersion>

In the present invention, a crystalline polyester resin dispersion may be added to the coagulant-containing dispersion prepared in Step I, and the styrene-acrylic resin, the release agent, and the crystalline polyester resin are coagulated and coalesced together under agitation, to prepare a core particle dispersion.

(Preparation of Crystalline Polyester Resin Dispersion)

The crystalline polyester resin dispersion is prepared through synthesis of a crystalline polyester resin and then dispersion of the crystalline polyester resin in the form of microparticles in an aqueous medium. Thus, the crystalline polyester resin dispersion may also be referred to as "crystalline polyester resin microparticle dispersion" below.

The crystalline polyester resin can be prepared as in the aforementioned process, and thus the redundant description is omitted. The crystalline polyester resin preferably satisfies Expression (A): $5 \leq |C_{acid} - C_{alcohol}| \leq 12$ where $C_{alcohol}$ represents the number of carbon atoms of a polyhydric alcohol forming the resin and $C_{acid}$ represents the number of carbon atoms of a polyvalent carboxylic acid forming the resin.

The crystalline polyester resin microparticle dispersion is prepared through, for example, a process involving dispersion treatment of the resin in an aqueous medium without use of an organic solvent, or a process involving swelling and dissolution of the resin in an organic solvent (e.g., ethyl acetate, methyl ethyl ketone, toluene, or a general-purpose alcohol having a boiling point of lower than 100° C.), emulsification and dispersion of the solution in an aqueous medium with a disperser, and then removal of the solvent.

The crystalline polyester resin may have a carboxy group. In such a case, ammonia or sodium hydroxide may be added to the crystalline polyester resin solution for ionic dissociation of the carboxy group contained in the resin and reliable and smooth emulsification in the aqueous phase.

The aqueous medium may contain a dispersion stabilizer. Alternatively, the aqueous medium may contain a surfactant or a microparticulate resin for improving the dispersion stability of oil droplets. The dispersion stabilizer, the surfactant, and the microparticulate resin may be the same as described in the section "preparation of styrene-acrylic resin particle dispersion."

The aforementioned dispersion treatment may be performed by use of mechanical energy with any disperser described above in the section "preparation of styrene-acrylic resin particle dispersion."

The crystalline polyester resin microparticles (oil droplets) in the crystalline polyester resin microparticle dispersion prepared as described above have a volume median particle size of preferably 50 to 1,000 nm, more preferably 50 to 500 nm, still more preferably 80 to 500 nm. The volume median particle size of the oil droplets can be adjusted by, for example, control of the mechanical energy during emulsification and dispersion.

The content of the crystalline polyester resin microparticles is preferably 10 to 50 mass %, more preferably 15 to 40 mass %, relative to the entire amount (100 mass %) of the crystalline polyester resin microparticle dispersion. A content of the crystalline polyester resin microparticles within the above range leads to a narrow particles size distribution and an improvement in properties of the toner.

[Step II]

Step II involves cooling the core particle dispersion prepared in Step I to a temperature equal to or lower than the glass transition temperature ($T_{g\text{-}a}$) of the amorphous resin A.

The cooling temperature is preferably equal to or lower than (the glass transition temperature ($T_{g\text{-}a}$) of the amorphous resin A−3)° C. If the cooling temperature is equal to or lower than ($T_{g\text{-}a}$−3)° C., the dispersion of the crystalline material in the core particles is maintained during deposition and coagulation of the shell resin particles, resulting in high image quality. This is probably attributed to the fact that the crystallinity of the crystalline material is ensured in the amorphous resin matrix, and the dispersion of the material in the core particles is maintained during deposition of the shell particles. The lower limit of the cooling temperature may be any value. The core particle dispersion is preferably cooled to ambient temperature, since a large amount of energy for heat removal is required for cooling the dispersion to room temperature or lower.

The core particles contained in the dispersion cooled in Step II preferably have a shape factor SF-2 of 105 to 140 because the shell is prepared from a small amount of the amorphous resin B and the resultant toner exhibits high compatibility between thermal resistance during storage and low-temperature fixing properties.

The shape factor SF-2 is preferably 107 to 135, preferably 110 to 130.

A shape factor SF-2 of more than 100 leads to avoidance of complete coating of the core particles with the shells, resulting in prevention of low releasability during fixation. A shape factor SF-2 of less than 140 leads to avoidance of insufficient coating of the core particles with the shells, resulting in satisfactory thermal resistance during storage.

The lowest cooling temperature in Step II may be lower than 30° C. The cooling temperature, however, is preferably 30° C. or higher in view of production efficiency, since further cooling does not greatly affect subsequent steps and requires excessive heat exchange.

The cooling rate may be any value, but is preferably 0.2 to 20° C./min, more preferably 1.0 to 10° C./min. A cooling rate falling with the above range leads to appropriate control of the internal structure and shape of the core particles in association with further crystallization of the crystalline polyester resin in the core particles.

A cooling rate of 0.2° C./min or more leads to prevention of formation of core particles of irregular shape during further crystallization of the crystalline polyester resin, resulting in a desired shape of the toner.

A cooling rate of 20° C./min or less leads to sufficient crystallization of the crystalline polyester resin. Thus, excessive fusion between the crystalline polyester resin and the amorphous polyester resin can be prevented during coagulation of the shells, resulting in appropriate formation of shell coats or coat domains. The cooling may be performed by any process, such as a process involving introduction of a cooling medium from outside into the reaction vessel, or a process involving direct injection of cooling water into the reaction system.

<Calculation of Shape Factor SF-2 of Core Particle>

For calculation of the shape factor SF-2, core particles are separated from the core particle dispersion prepared in Step II and then dried, and a cross-sectional image of the core particles is captured. The shape factor SF-2 is calculated by Expression (1):

$$\text{the shape factor } SF\text{-}2 \text{ of a toner matrix particle} = [(\text{the perimeter of the toner matrix particle})^2/(\text{the projection area of the toner matrix particle})] \times (1/4\pi) \times 100 \quad \text{Expression (1):}$$

A large shape factor SF-2 of a particle indicates that the particle has a very irregular shape.

<Observation of Cross Section of Core Particle>

(Preparation of Section of Core Particle for Observation)

Core particles are placed into a sample vial and stained with vapor of ruthenium tetroxide ($RuO_4$). The resultant particles are dispersed in a photocurable resin (embedding resin) and then photo-cured to form a block. The block is then sliced into an ultrathin sample having a thickness of 60 to 100 nm.

(Observation of Cross Section of Core Particle)

The sliced sample is observed under the conditions described below. The shape factor SF-2 of the core particles is calculated on the basis of data prepared by 30-visual-field photographing of cross sections having a diameter within a range of volume median particle size (D50) of the core particles ±10%.

Apparatus: transmission electron microscope "JSM-7401F" (manufactured by JEOL Ltd.)

Accelerating voltage: 30 kV

Magnification: 10,000 to 20,000

[Step III]

Step III involves adjusting the temperature of the core particle dispersion to be equal to or higher than (the glass transition temperature ($T_{g\text{-}a}$) of the amorphous resin A+5)° C. and equal to or lower than (the glass transition temperature ($T_{g\text{-}b}$) of the amorphous resin B+3)° C. after Step II, and then adding a dispersion of the amorphous resin B to the core particle dispersion.

More preferably, the temperature of the core particle dispersion is adjusted to be equal to or higher than (the glass transition temperature ($T_{g\text{-}a}$) of the amorphous resin A+7)° C. and equal to or lower than (the glass transition temperature ($T_{g\text{-}b}$) of the amorphous resin B+1)° C.

A temperature adjusted to be equal to or higher than (the glass transition temperature ($T_{g\text{-}a}$)+5)° C. is preferred in view of productivity (i.e., prevention of a reduction in molecular motion of the amorphous resin B, and shortening of the time for deposition of particles of the amorphous resin B onto core particles).

A temperature adjusted to be equal to or lower than ($T_{g-b}$+3)° C. leads to prevention of coagulation between particles of the amorphous resin B and intrusion of the amorphous resin B into the core particles, resulting in prevention of domain formation (formation of large shell particles).

The amorphous resin B added in Step III is preferably in the form of particles having a volume median particle size of 30 to 300 nm.

A volume median particle size of the amorphous resin B particles of 30 to 300 nm leads to even deposition of shell particles and sufficient coating of the core particles with a small number of shell particles. A volume median particle size of 30 nm or more leads to prevention of coagulation between shell particles, whereas a volume median particle size of 300 nm or less leads to sufficient coating of the core particles with shell particles, resulting in prevention of excessive exposure of the core particles.

The ratio of the mass of the amorphous resin B added in Step III to the total mass of the binder resin is preferably 5 to 35, more preferably 10 to 25, in view of improvements in thermal resistance during storage and releasability during fixation of the toner. A mass ratio of 5 or more leads to sufficient coating of the core particles with the shells, resulting in further improved thermal resistance during storage of the toner, whereas a mass ratio of 35 or less leads to higher thermal resistance and improved releasability during fixation of the toner.

Expressions 1 and 2 are preferably satisfied in Step III:

$$pH_b \leq pH_a, \text{ and} \qquad \text{Expression 1:}$$

$$2 \leq pH_b \leq 5 \qquad \text{Expression 2:}$$

where $pH_a$ represents the pH of the core particle dispersion at 25° C. before addition of the amorphous resin B dispersion, and $pH_b$ represents the pH of the amorphous resin B dispersion at 25° C. before being added to the core particle dispersion.

If Expressions 1 and 2 are satisfied, the amorphous resin B particles are coagulated and deposited onto the core particles while the coagulation between the amorphous resin B particles is prevented. If Expressions 1 and 2 are satisfied, the amorphous resin B particles can be evenly deposited onto the core particles, resulting in formation of shells having uniform thickness and thus improved thermal resistance during storage. From this viewpoint, the $pH_a$ and $pH_b$ more preferably satisfy the following expressions: $6 \leq pH_a \leq 8$ and $2 \leq pH_b \leq 3$. A $pH_a$ of less than 8 leads to reduced coagulation between core particles, resulting in reduced amount of residue.

In order to control the rate of coagulation between shell particles and core particles after addition of the amorphous resin B dispersion, the agitation rate may be adjusted, the core particle dispersion may be heated/cooled to a temperature equal to or higher than (the glass transition temperature ($T_{g-a}$) of the amorphous resin A+5)° C. and equal to or lower than (the glass transition temperature ($T_{g-b}$) of the amorphous resin B+3)° C., and a pH adjuster may be used for adjustment of the $pH_a$ and $pH_b$ to satisfy Expressions 1 and 2.

The pH adjuster may be any acid or alkali that dissolves in water. Specific examples of the pH adjuster are described below.

Examples of the alkali include inorganic bases, such as sodium hydroxide and potassium hydroxide, and ammonia.

Examples of the acid include inorganic acids, such as hydrochloric acid, nitric acid, sulfuric acid, phosphoric acid, and boric acid; sulfonic acids, such as methanesulfonic acid, ethanesulfonic acid, and benzenesulfonic acid; and carboxylic acids, such as acetic acid, citric acid, and formic acid.

(Measurement of pH)

The pH of the core particle dispersion at 25° C. ($pH_a$) and the pH of the amorphous polyester resin particle dispersion at 25° C. ($pH_b$) before being added to the core particle dispersion can be measured as described below.

In specific, the pH of the core particle dispersion at 25° C. and the pH of the amorphous polyester resin particle dispersion at 25° C. before being added to the core particle dispersion can be measured with a glass-electrode hydrogen ion concentration meter HM-20P (manufactured by DKK-TOA CORPORATION) (reference electrode internal solution RE-4 calibrated with the following three standard solutions: phthalate standard solution (pH 4.01, 25° C.), neutral phosphate standard solution (pH 6.86, 25° C.), and borate standard solution (pH 9.18, 25° C.)).

[Heating-Cooling Step]

After addition of the amorphous resin B dispersion, the resultant dispersion of shell-deposited core particles is heated, and an aqueous sodium chloride solution (i.e., a coagulation stopper) is added to the dispersion, followed by fusion between core particles and shell particles and fusion between shell particles. The resultant product is then cooled to terminate the fusion of the particles, to prepare a core-shell toner matrix particle dispersion.

[Separation-Drying Step]

Core-shell toner matrix particles are separated from the core-shell toner matrix particle dispersion and then dried.

The core-shell toner matrix particles may be separated from the core-shell toner matrix particle dispersion by any known technique.

For example, the separation step may involve any filtration technique, such as centrifugation, filtration at reduced pressure with a Nutsche filter, or filtration with a filter press.

The separated core-shell toner matrix particles may optionally be washed. The washing step may involve removal of deposits (e.g., the surfactant and the coagulant) from the separated core-shell toner matrix particles (caked agglomeration of particles). The washing step is preferably continued until the conductivity of the washings reaches, for example, 1 to 10 μS/cm.

The separated or washed core-shell toner matrix particles are then dried. The drying step may be performed with any technique with, for example, any known dryer. Examples of such dryers include spray dryers, vacuum freeze dryers, reduced-pressure dryers, stationary shelf dryers, mobile shelf dryers, fluidized bed dryers, rotary dryers, and stirring dryers. The water content of the dried toner matrix particles is preferably 5 mass % or less, more preferably 2 mass % or less.

If the dried core-shell toner matrix particles are coagulated by weak interparticle force, the coagulated particles may be subjected to disintegration treatment. This treatment may involve the use of a mechanical disintegrator, such as a jet mill, a Henschel mixer, a coffee mill, or a food processor.

[Application of External Additive]

An external additive may optionally be applied to the core-shell toner matrix particles according to the present invention. This step involves optional mixing of an external additive with the dried core-shell toner matrix particles, to produce a toner. The application of the external additive improves the fluidity, charging properties, and cleanability of the toner.

<<Developer>>

The toner produced by the method of the present invention is suitable for the following use. For example, the toner may be used as a magnetic one-component developer containing a magnetic material. Alternatively, the toner may be mixed with a carrier and used as a two-component developer. Alternatively, the toner may be used alone as a non-magnetic toner.

The carrier for forming the two-component developer may be magnetic particles composed of any known material, such as a metal material (e.g., iron, ferrite, or magnetite) or an alloy of such a metal and aluminum or lead. Ferrite particles are particularly preferred.

The carrier has a volume average particle size of preferably 15 to 100 μm, more preferably 25 to 60 μm.

The carrier is preferably coated with a resin or in the form of a dispersion of magnetic particles in a resin. Non-limiting examples of the resin for coating of the carrier include olefinic resins, cyclohexyl methacrylate-methyl methacrylate copolymers, styrenic resins, styrene-acrylic resins, silicone resins, ester resins, and fluororesins. Non-limiting examples of the resin for forming the dispersion include known resins, such as acrylic resins, styrene-acrylic resins, polyester resins, fluororesins, and phenolic resins.

<<Fixation>>

The fixation of the toner of the present invention preferably involves the use of a contact heating process. Examples of the contact heating process include a thermal pressure fixing process, a thermal roller fixing process, and a thermocompression fixing process involving the use of a rotary pressure unit including a fixed heater.

The aforementioned embodiments of the present invention should not be construed to limit the invention, and various modifications of the invention may be made.

The present invention may be appropriately modified without departing from the scope of the invention.

EXAMPLES

The present invention will now be described in detail by way of examples, which should not be construed to limit the present invention. In the following examples, the term "parts" and the symbol "%" refer to "parts by mass" and "mass %," respectively, unless otherwise specified.

In toners 1 to 26, the melting point ($T_{m-c}$) of a crystalline material, the glass transition temperature ($T_{g-a}$) of an amorphous resin A, and the glass transition temperature ($T_{g-b}$) of an amorphous resin B were measured as described below.

[Measurement of Melting Point ($T_{m-c}$) of Crystalline Material]

The melting point of a crystalline material in the toner was measured with a differential scanning calorimeter "Diamond DSC" (manufactured by PerkinElmer, Inc.). In detail, a sample of the toner (3.0 mg) was sealed in an aluminum pan and placed on a sample holder of the calorimeter. The calorimetry was performed by the following temperature program: a first heating process involving heating from room temperature (25° C.) to 150° C. at a rate of 10° C./min and maintaining at 150° C. for five minutes; a cooling process involving cooling from 150° C. to 0° C. at a rate of 10° C./min and maintaining at 0° C. for five minutes; and a second heating process involving heating from 0° C. to 150° C. at a rate of 10° C./min. An empty aluminum pan was used as a reference.

An endothermic curve prepared through the first heating process was analyzed, and the maximum temperature of the endothermic peak of the crystalline material was defined as the melting point $T_{m-c}$ (° C.) of the crystalline material. An exothermic curve prepared through the cooling process was analyzed, and the maximum temperature of the exothermic peak of the crystalline material was defined as $T_{q-c}$ (° C.).

[Measurement of Glass Transition Temperature $T_g$ of Amorphous Resin]

The glass transition temperature ($T_{g-a}$) of the amorphous resin A and the glass transition temperature ($T_{g-b}$) of the amorphous resin B was determined with a differential scanning calorimeter "Diamond DSC" (manufactured by PerkinElmer, Inc.). The temperature of a sample was controlled through sequential processes of heating, cooling, and heating (temperature range: 0 to 150° C., heating rate: 10° C./minute, cooling rate: 10° C./minute). The glass transition temperature was determined on the basis of the data obtained through the second heating process. In detail, the glass transition temperature corresponded to the intersection of a line extending from the base line of the first endothermic peak and a tangent corresponding to the maximum slope between the rising point and maximum point of the first endothermic peak.

[Preparation of Amorphous Resin Particle Dispersion S-1 (Styrene-Acrylic Resin Particles)]

A styrene-acrylic resin dispersion containing a release agent disclosed in, for example, Japanese Patent No. 3915383 was used in amorphous resin particle dispersion S-1. The dispersion was prepared as detailed below.

(1) First Polymerization Step

Sodium dodecyl sulfate (8 parts by mass) and deionized water (3,000 parts by mass) were placed in a 5-L reactor equipped with an agitator, a thermosensor, a cooling tube, and a nitrogen feeder, and the mixture was agitated at 230 rpm under a nitrogen gas stream while the internal temperature was raised to 80° C. After the temperature reached 80° C., a solution of potassium persulfate (10 parts by mass) in deionized water (200 parts by mass) was added to the reactor, and the temperature of the mixture was raised again to 80° C. The following mixture of monomers was added dropwise to the reactor over one hour, and the resultant mixture was then heated and agitated at 80° C. for two hours for polymerization, to prepare resin microparticle dispersion x1:

styrene, 480 parts by mass;
n-butyl acrylate, 250 parts by mass; and
methacrylic acid, 68 parts by mass.

(2) Second Polymerization Step

A solution of sodium polyoxyethylene (2) dodecyl ether sulfate (7 parts by mass) in deionized water (3,000 parts by mass) was placed in a 5-L reactor equipped with an agitator, a thermosensor, a cooling tube, and a nitrogen feeder, and was heated to 98° C. Resin microparticle dispersion x1 (260 parts by mass) and a mixture prepared through dissolution of the following monomers and release agent at 90° C. was added to the heated solution:

styrene (St), 284 parts by mass;
n-butyl acrylate (BA), 92 parts by mass;
methacrylic acid (MAA), 13 parts by mass;
n-octyl 3-mercaptopropionate, 3.0 parts by mass; and
release agent: behenyl behenate (melting point ($T_{m-c}$): 73° C.), 140 parts by mass. The resultant mixture was processed for one hour in a mechanical disperser "CLEARMIX" having a circulation path (manufactured by M Technique Co., Ltd.), to prepare a dispersion containing emulsified particles (oil droplets).

A solution of potassium persulfate (6 parts by mass) in deionized water (200 parts by mass) (i.e., a polymerization initiator solution) was added to the dispersion. The mixture was heated with agitation for one hour at 84° C. for polymerization, to prepare resin microparticle dispersion x2.

(3) Third Polymerization Step

A solution of potassium persulfate (11 parts by mass) in deionized water (400 parts by mass) was added to resin microparticle dispersion x2. The composition of the following monomers was added dropwise to the mixture over one hour at a temperature of 82° C.:

styrene (St), 350 parts by mass;

n-butyl acrylate (BA), 215 parts by mass;

methacrylic acid (MAA), 20 parts by mass; and n-octyl 3-mercaptopropionate, 8 parts by mass. After completion of the dropwise addition, the resultant mixture was heated with agitation for two hours for polymerization and was cooled to 28° C., to prepare amorphous resin particle dispersion S-1 of vinyl resin (styrene-acrylic resin).

The amorphous resin particles contained in amorphous resin particle dispersion S-1 had a volume median particle size of 210 nm, a glass transition temperature ($T_g$) (of dried matter) of 40° C., and a weight average molecular weight (Mw) of 33,000.

[Preparation of Amorphous Resin Particle Dispersion S-2 (Styrene-Acrylic Resin Particles)]

Sodium dodecyl sulfate (8 parts by mass) and deionized water (3,000 parts by mass) were placed in a 5-L reactor equipped with an agitator, a thermosensor, a cooling tube, and a nitrogen feeder, and the mixture was agitated at 230 rpm under a nitrogen gas stream while the internal temperature was raised to 80° C. After the temperature reached 80° C., a solution of potassium persulfate (10 parts by mass) in deionized water (200 parts by mass) was added to the reactor, and the temperature of the mixture was raised again to 80° C. The following mixture of monomers was added dropwise to the reactor over one hour, and the resultant mixture was then heated and agitated at 88° C. for two hours for polymerization, to prepare amorphous resin particle dispersion S-2:

styrene, 460 parts by mass;

n-butyl acrylate, 250 parts by mass;

methacrylic acid, 88 parts by mass; and n-octyl 3-mercaptopropionate, 7 parts by mass.

The amorphous resin particles contained in amorphous resin particle dispersion S-2 had a volume median particle size of 103 nm, a glass transition temperature ($T_g$) (of dried matter) of 61° C., and a weight average molecular weight (Mw) of 28,000.

[Preparation of Colorant Dispersion]

Sodium dodecyl sulfate (90 parts by mass) was dissolved in deionized water (1,600 parts by mass) with agitation, and carbon black "MOGUL L" (manufactured by Cabot Corporation) (420 parts by mass) was gradually added to the solution with agitation. The carbon black was then dispersed in the solution with an agitator "CLEARMIX" (manufactured by M Technique Co., Ltd.), to prepare carbon black particle dispersion [Bk]. The carbon black particles [Bk] contained in the dispersion had a volume median particle size of 115 nm as determined with a particle size analyzer Microtrac UPA-150 (manufactured by NIKKISO CO., LTD.).

[Preparation of Release Agent Dispersion]

Sodium polyoxyethylene (2) dodecyl ether sulfate (24 parts by mass) was dissolved in deionized water (1,200 parts by mass) with agitation. Behenyl behenate (240 parts by mass) used in S-1 was gradually added to solution with agitation, and then dispersed in the solution under heating with an agitator "CLEARMIX" (manufactured by M Technique Co., Ltd.), to prepare a release agent particle dispersion. The release agent particles contained in the dispersion had a volume median particle size of 355 nm as determined with a particle size analyzer Microtrac UPA-150 (manufactured by NIKKISO CO., LTD.).

[Preparation of Amorphous Resin Particle Dispersion P-1]

<Synthesis of Amorphous Polyester Resin p1>

The following monomers (including a bireactive monomer) for an addition-polymerization resin (styrene-acrylic resin: St-Ac) unit and a radical polymerization initiator were added to a dropping funnel:

styrene, 80 parts by mass;

n-butyl acrylate, 20 parts by mass;

acrylic acid, 10 parts by mass; and polymerization initiator (di-t-butyl peroxide), 16 parts by mass.

The following monomers for a polycondensation resin (amorphous polyester resin) unit were added to a four-neck flask equipped with a nitrogen feeding tube, a dehydration tube, an agitator, and a thermocouple, and were dissolved at 170° C.:

propylene oxide (2 mol) adduct of bisphenol A, 255.5 parts by mass;

ethylene oxide (2 mol) adduct of bisphenol A, 30.2 parts by mass;

terephthalic acid, 56.3 parts by mass;

fumaric acid, 35.0 parts by mass; and adipic acid, 22.0 parts by mass.

An esterification catalyst $Ti(OBu)_4$ (0.4 parts by mass) was then added to the reaction system. The reaction system was heated to 235° C., and the reaction was allowed to proceed at ambient pressure (101.3 kPa) for five hours and then at reduced pressure (8 kPa) for one hour.

After the reaction system was cooled to 200° C., the monomers for the addition-polymerization resin were added dropwise to the flask over 90 minutes with agitation and aged for 60 minutes. The unreacted monomers were then removed at reduced pressure (8 kPa), and the reaction was continued until a desired softening point was achieved, to prepare amorphous polyester resin p1. Amorphous polyester resin p1 had a glass transition temperature ($T_g$) of 60° C., a weight average molecular weight (Mw) of 27,000, and a softening point of 109° C.

[Preparation of Amorphous Resin Particle Dispersion P-1]

Amorphous polyester resin p1 (100 parts by mass) was dissolved in ethyl acetate (manufactured by Kanto Chemical Co., Inc.) (400 parts by mass), and was mixed with a preliminarily prepared 0.4 mass % sodium lauryl sulfate solution (638 parts by mass). The mixed solution was ultrasonically dispersed with an ultrasonic homogenizer "US-150T" (manufactured by NIHONSEIKI KAISHA LTD.) at a V-LEVEL of 300 μA for 35 minutes with agitation. While the dispersion was maintained at 40° C., ethyl acetate was completely removed with a diaphragm vacuum pump "V-700" (manufactured by BUCHI) with agitation at reduced pressure for three hours, to prepare amorphous resin particle dispersion P-1 (solid content: 13.5 mass %). The particles contained in amorphous resin particle dispersion P-1 had a volume median particle size ("particle size" in TABLE 1) of 120 nm.

[Preparation of Amorphous Resin Particle Dispersion P-2 (Amorphous Polyester Resin Dispersion)]

<Synthesis of Amorphous Polyester Resin p2>

Amorphous polyester resin p2 was synthesized as in amorphous polyester resin p1, except that the monomers for a polycondensation resin were modified as follows:

fumaric acid, 30.0 parts by mass; and adipic acid, 27.0 parts by mass.

The reaction was continued until a softening point of 96° C. was achieved to prepare amorphous polyester resin p2. Amorphous polyester resin p2 had a glass transition temperature ($T_g$) of 43° C. and a weight average molecular weight (Mw) of 16,000.

<Preparation of Amorphous Resin Particle Dispersion P-2>

Amorphous resin particle dispersion P-2 was prepared as in amorphous resin particle dispersion P-1, except that amorphous polyester resin p1 was replaced with amorphous polyester resin p2. The particles contained in amorphous resin particle dispersion P-2 had a volume median particle size of 130 nm.

[Preparation of Crystalline Resin Particle Dispersion C1 (Crystalline Polyester Resin Particle Dispersion)]

<Synthesis of Crystalline Polyester Resin c1>

1,14-Tetradecanedicarboxylic acid (281 parts by mass) and 1,6-hexanediol (259 parts by mass) were placed in a reactor equipped with an agitator, a thermometer, a cooling tube, and a nitrogen gas feeding tube. After the reactor was purged with dry nitrogen gas, an esterification catalyst $Ti(OBu)_4$ (0.1 parts by mass) was added to the mixture, and the mixture was agitated for about eight hours under a nitrogen gas stream at about 180° C.

The following monomers (including a bireactive monomer) for an addition-polymerization resin (styrene-acrylic resin: StAc) unit and a radical polymerization initiator were added to a dropping funnel:

styrene, 34 parts by mass;

n-butyl acrylate, 12 parts by mass;

acrylic acid, 2 parts by mass; and polymerization initiator (di-t-butyl peroxide), 7 parts by mass.

The monomers for the addition-polymerization resin (StAc) were added dropwise to the flask over 90 minutes with agitation and aged for 60 minutes, and then the unreacted monomers were removed at reduced pressure (8 kPa). The ratio of the amount of the removed monomers to that of the added monomers was very low. An esterification catalyst $Ti(OBu)_4$ (0.8 parts by mass) was then added to the reaction system. The reaction system was heated to 235° C., and the reaction was allowed to proceed at ambient pressure (101.3 kPa) for five hours and then at reduced pressure (8 kPa) for one hour.

After the reaction system was cooled to 200° C., the reaction was continued at reduced pressure (20 kPa) for 1.5 hours, to prepare crystalline polyester resin c1 (i.e., hybrid crystalline polyester resin). The content of StAc unit (other than CPEs) was 10 mass % relative to the entire amount of crystalline polyester resin c1. Crystalline polyester resin c1 had a structure composed of CPEs grafted to StAc. Crystalline polyester resin c1 had a number average molecular weight (Mn) of 4,900 and a melting point ($T_{m-c}$) of 73° C.

[Preparation of Crystalline Resin Particle Dispersion C1]

Crystalline polyester resin c1 (30 parts by mass) was melted and transferred to an emulsifier "Cavitron CD1010" (manufactured by EUROTEC LIMITED) at a rate of 100 parts by mass/min. Aqueous ammonia (70 parts by mass) was diluted with deionized water in an aqueous solvent tank. While being heated with a heat exchanger at 100° C., the diluted aqueous ammonia (concentration: 0.37 mass %) was transferred to the emulsifier "Cavitron CD1010" at a rate of 0.1 L/min simultaneous with the transfer of crystalline polyester resin c1. The emulsifier "Cavitron CD1010" was operated at a rotor speed of 60 Hz and a pressure of 490.3 kPa (5 kg/cm$^2$), to prepare crystalline resin particle dispersion C1 (solid content: 30 parts by mass). The particles contained in crystalline resin particle dispersion C1 had a volume median particle size of 220 nm.

[Preparation of Toner Matrix Particles 1]

Amorphous resin particle dispersion S-1 (200 parts by mass in terms of solid content), the colorant dispersion (20 parts by mass in terms of solid content), and deionized water (2,000 parts by mass) were placed in a reactor equipped with an agitator, a thermosensor, and a cooling tube. A 5 mol/L aqueous sodium hydroxide solution was then added to the reactor to adjust the pH of the mixture to 10. A solution of magnesium chloride (60 parts by mass) in deionized water (60 parts by mass) was added to the mixture in the reactor with agitation at 25° C. over 10 minutes.

The resultant mixture was heated with agitation to 75° C. ("coagulation and coalescence temperature" in TABLE 2), and the agitation rate was appropriately controlled. The particle size of associated particles was determined with a particle size analyzer "Coulter Multisizer 3" (manufactured by Beckman Coulter, Inc.). The coagulation and coalescence of the associated particles was continued until the volume median particle size of the particles reached 5.8 μm, and then the agitation rate was adjusted to terminate the coagulation. The coagulation and coalescence temperature was maintained for one hour to prepare a core particle dispersion (Step I).

The core particle dispersion was then cooled to 35° C. ("cooling temperature" in TABLE 2) (Step II). A 5 mol/L aqueous sodium hydroxide solution was added to the dispersion to adjust the pH to 7 (at 25° C.), and then the resultant mixture was heated to 61° C. ("temperature during addition of amorphous resin B" in TABLE 2). Amorphous resin particle dispersion P-1 (i.e., amorphous resin B dispersion) (pH 2) (200 parts by mass in terms of solid content) was added to the mixture over 20 minutes (Step III). After confirmation of the deposition of shell particles (i.e., amorphous resin B particles) onto core particles, the resultant dispersion was heated to 73° C.

A solution of sodium chloride (120 parts by mass) in deionized water (650 parts by mass) was added to the dispersion, and the fusion of the particles was allowed to proceed while the volume median particle size of the particles was maintained. The average sphericity of the particles contained in the dispersion was determined with a particle image analyzer "FPIA-3000" (manufactured by Sysmex Corporation) (4000 particles detected in a high-power field (HPF)). After the average sphericity reached 0.963, the dispersion was cooled to 35° C. to terminate the fusion of the particles.

Toner dispersion 1 containing toner matrix particles 1 was thereby prepared.

Toner matrix particles 1 were separated from toner dispersion 1, washed, and then dried until a water content of less than 1% was achieved.

<Calculation of Shape Factor SF-2 of Core Particle>

Core particles were separated from the core particle dispersion prepared in Step II and then dried, and a cross-sectional image of the core particles was captured as described below. The shape factor SF-2 of the core particles was calculated by Expression (1). The results are illustrated in TABLE 2.

$$\text{the shape factor } SF\text{-}2 \text{ of a toner matrix particle} = [(\text{the perimeter of the toner matrix particle})^2/(\text{the projection area of the toner matrix particle})] \times (1/4\pi) \times 100 \quad \text{Expression (1):}$$

<Observation of Cross Section of Core Particle>

(Preparation of Section of Core Particle for Observation)

Core particles (0.2 to 1 g) were placed into a 10-mL sample vial and stained with vapor of ruthenium tetroxide ($RuO_4$) as described below. The resultant particles were dispersed in a photocurable resin "D-800" (manufactured by JEOL Ltd.) and then photo-cured to form a block. The block was then sliced with a microtome having a diamond blade into an ultrathin sample having a thickness of 60 to 100 nm.

The sample was optionally treated with ruthenium tetroxide in view of ease of observation. The ruthenium tetroxide treatment involves the use of a vacuum electron staining apparatus VSC1R1 (manufactured by Filgen, Inc.). In detail, the toner or ultrathin sample was introduced into a ruthenium tetroxide-containing sublimation chamber (staining chamber) provided in the apparatus, and then stained with ruthenium tetroxide at room temperature (24 to 25° C.) and concentration level 3 (300 Pa) for 10 minutes.

<Observation of Cross Section of Core Particle>

The stained sample was observed under the conditions described below. The shape factor SF-2 of the core particles was calculated on the basis of data prepared by 30-visual-field photographing of cross sections having a diameter within a range of volume median particle size (D50) of the core particles ±10%.

Apparatus: transmission electron microscope "JSM-7401F" (manufactured by JEOL Ltd.)

Accelerating voltage: 30 kV

Magnification: 10,000

[Preparation of Toner Matrix Particles 2 to 5 and 7 to 26]

Toner matrix particles 2 to 5 and 7 to 26 were prepared as in toner matrix particles 1, except that the conditions for the preparation were modified as illustrated in TABLEs 1 and 2. TABLE 1 also illustrates the proportion of the mass of the amorphous resin A, the crystalline resin, or the amorphous resin B to the total mass of the binder resin (i.e., the total mass of the amorphous resin A, the crystalline resin, and the amorphous resin B) (the proportion will be referred to as "mass ratio" in TABLE 1).

[Preparation of Toner Matrix Particles 6]

Amorphous resin particle dispersion S-1 (200 parts by mass in terms of solid content), the colorant dispersion (20 parts by mass in terms of solid content), and deionized water (2,000 parts by mass) were placed in a reactor equipped with an agitator, a thermosensor, and a cooling tube. A 5 mol/L aqueous sodium hydroxide solution was then added to the reactor to adjust the pH of the mixture to 10. A solution of magnesium chloride (60 parts by mass) in deionized water (60 parts by mass) was added to the mixture with agitation at 25° C. over 10 minutes.

The resultant mixture was heated with agitation to 75° C., and crystalline resin particle dispersion C1 (20 parts by mass in terms of solid content) was added to the mixture over 20 minutes. The agitation rate was appropriately controlled, and the particle size of associated particles was determined with a particle size analyzer "Coulter Multisizer 3" (manufactured by Beckman Coulter, Inc.). The coagulation of the associated particles was continued until the volume median particle size of the particles reached 5.8 μm, and then the agitation rate was adjusted to terminate the coagulation. The resultant mixture was heated to 75° C. and maintained at the temperature for one hour, to prepare a core particle dispersion (Step I).

The core particle dispersion was cooled to 35° C. (Step II), and then a 5 mol/L aqueous sodium hydroxide solution was added to the dispersion to adjust the pH to 7 (at 25° C.). The resultant mixture was heated to 61° C., and amorphous resin particle dispersion P-1 (pH 2) was added to the mixture over 20 minutes (Step III). After confirmation of the coagulation and deposition of shell particles onto core particles, a solution of sodium chloride (100 parts by mass) in deionized water (760 parts by mass) was added to the mixture to terminate the growth (coagulation) of the particles. The resultant dispersion was heated and agitated at 72° C. to allow the fusion of the particles to proceed. The average sphericity of the particles contained in the dispersion was determined with a particle image analyzer "FPIA-3000" (manufactured by Sysmex Corporation) (4000 particles detected in a high-power field (HPF) mode). After the average sphericity reached 0.963, the dispersion was cooled to 35° C. to terminate the fusion of the particles. Toner dispersion 6 containing toner matrix particles 6 was thereby prepared.

Toner matrix particles 6 were separated from toner dispersion 6, washed, and then dried until a water content of less than 1%.

TABLE 1

| Toner matrix particle No. | Constitution: Core particle: Amorphous resin A: Dispersion No. | $T_{g-b}$ [° C.] | Mass ratio | Crystalline material: Release agent: Type | $T_{m-c}$ [° C.] | Crystalline resin: Dispersion No. | Mass ratio | $T_{m-c}$ [° C.] | Shell: Amorphous resin B: Dispersion No. | Particlesize [nm] | $T_{g-b}$ [° C.] | Mass ratio | Note |
|---|---|---|---|---|---|---|---|---|---|---|---|---|---|
| 1 | S-1 | 40 | 85 | Behenyl behenate | 73 | — | — | — | P-1 | 120 | 60 | 15 | Example |
| 2 | S-1 | 40 | 85 | Behenyl behenate | 73 | — | — | — | P-1 | 120 | 60 | 15 | Example |
| 3 | S-1 | 40 | 85 | Behenyl behenate | 73 | — | — | — | P-1 | 120 | 60 | 15 | Example |
| 4 | S-1 | 40 | 85 | Behenyl behenate | 73 | — | — | — | P-1 | 120 | 60 | 15 | Example |
| 5 | S-1 | 40 | 85 | Behenyl behenate | 73 | — | — | — | P-1 | 120 | 60 | 15 | Example |
| 6 | S-1 | 40 | 78 | Behenyl behenate | 73 | C-1 | 7 | 73 | P-1 | 120 | 60 | 15 | Example |
| 7 | S-1 | 40 | 94 | Behenyl behenate | 73 | — | — | — | P-1 | 120 | 60 | 6 | Example |
| 8 | S-1 | 40 | 70 | Behenyl behenate | 73 | — | — | — | P-1 | 120 | 60 | 30 | Example |
| 9 | S-1 | 40 | 85 | Behenyl behenate | 73 | — | — | — | P-1 | 120 | 60 | 15 | Example |
| 10 | P-2 | 43 | 85 | Behenyl behenate | 73 | — | — | — | S-2 | 103 | 61 | 15 | Example |
| 11 | P-2 | 43 | 85 | Behenyl behenate | 73 | — | — | — | S-2 | 103 | 61 | 15 | Example |
| 12 | P-2 | 43 | 87 | Behenyl behenate | 73 | — | — | — | S-2 | 103 | 61 | 13 | Example |
| 13 | P-2 | 43 | 87 | Behenyl behenate | 73 | — | — | — | S-2 | 103 | 61 | 13 | Example |
| 14 | P-2 | 43 | 87 | Behenyl behenate | 73 | — | — | — | S-2 | 103 | 61 | 13 | Example |

TABLE 1-continued

| Toner matrix particle No. | Constitution: Core particle: Amorphous resin A: Dispersion No. | $T_{g\text{-}b}$ [° C.] | Mass ratio | Crystalline material: Release agent: Type | $T_{m\text{-}c}$ [° C.] | Crystalline resin: Dispersion No. | Mass ratio | $T_{m\text{-}c}$ [° C.] | Shell: Amorphous resin B: Dispersion No. | Particlesize [nm] | $T_{g\text{-}b}$ [° C.] | Mass ratio | Note |
|---|---|---|---|---|---|---|---|---|---|---|---|---|---|
| 15 | P-2 | 43 | 87 | Behenyl behenate | 73 | — | — | — | S-2 | 103 | 61 | 13 | Example |
| 16 | P-2 | 43 | 94 | Behenyl behenate | 73 | — | — | — | S-2 | 103 | 61 | 6 | Example |
| 17 | P-2 | 43 | 70 | Behenyl behenate | 73 | — | — | — | S-2 | 103 | 61 | 30 | Example |
| 18 | S-1 | 40 | 85 | Behenyl behenate | 73 | — | — | — | P-1 | 120 | 60 | 15 | Example |
| 19 | S-1 | 40 | 85 | Behenyl behenate | 73 | — | — | — | P-1 | 120 | 60 | 15 | Example |
| 20 | S-1 | 40 | 85 | Behenyl behenate | 73 | — | — | — | P-1 | 120 | 60 | 15 | Comparative Example |
| 21 | S-1 | 40 | 85 | Behenyl behenate | 73 | — | — | — | P-1 | 120 | 60 | 15 | Comparative Example |
| 22 | S-1 | 40 | 85 | Behenyl behenate | 73 | — | — | — | P-1 | 120 | 60 | 15 | Comparative Example |
| 23 | S-1 | 40 | 85 | Behenyl behenate | 73 | — | — | — | P-1 | 120 | 60 | 15 | Example |
| 24 | P-2 | 43 | 87 | Behenyl behenate | 73 | — | — | — | S-2 | 103 | 61 | 13 | Comparative Example |
| 25 | P-2 | 43 | 87 | Behenyl behenate | 73 | — | — | — | S-2 | 103 | 61 | 13 | Comparative Example |
| 26 | P-2 | 43 | 87 | Behenyl behenate | 73 | — | — | — | S-2 | 103 | 61 | 13 | Comparative Example |

TABLE 2

| Toner matrix particle No. | Production conditions: Step I Coagulation and coalescence temperature [° C.] | Step II: Cooling Temperature [° C.] | SF-2 | Step III: Temperature during addition of amorphous resin B [° C.] | $pH_a$ | $pH_a$ | Note |
|---|---|---|---|---|---|---|---|
| 1 | 75 | 35 | 137 | 61 | 7 | 2 | Example |
| 2 | 78 | 35 | 121 | 61 | 7 | 2 | Example |
| 3 | 82 | 35 | 107 | 61 | 7 | 2 | Example |
| 4 | 78 | 40 | 122 | 61 | 7 | 2 | Example |
| 5 | 78 | 35 | 121 | 61 | 6 | 5 | Example |
| 6 | 75 | 35 | 126 | 61 | 7 | 2 | Example |
| 7 | 78 | 35 | 123 | 61 | 7 | 2 | Example |
| 8 | 78 | 35 | 119 | 61 | 7 | 2 | Example |
| 9 | 78 | 35 | 121 | 63 | 6.5 | 2 | Example |
| 10 | 68 | 39 | 135 | 62 | 6.5 | 3 | Example |
| 11 | 75 | 39 | 108 | 62 | 6.5 | 3 | Example |
| 12 | 73 | 38 | 120 | 61 | 6.5 | 3 | Example |
| 13 | 73 | 38 | 119 | 61 | 6 | 5 | Example |
| 14 | 73 | 43 | 121 | 61 | 6.5 | 3 | Example |
| 15 | 73 | 38 | 120 | 64 | 6.5 | 3 | Example |
| 16 | 73 | 38 | 126 | 61 | 6.5 | 3 | Example |
| 17 | 73 | 38 | 118 | 61 | 6.5 | 3 | Example |
| 18 | 53 | 35 | 140 | 61 | 7 | 2 | Example |
| 19 | 75 | 35 | 121 | 48 | 7 | 2 | Example |
| 20 | 84 | 35 | 104 | 61 | 7 | 2 | Comparative Example |
| 21 | 78 | 78 (No cooling) | 121 | 78 | 7 | 2 | Comparative Example |
| 22 | 78 | 35 | 121 | 66 | 7 | 2 | Comparative Example |
| 23 | 78 | 35 | 121 | 61 | 7 | 6 | Example |
| 24 | 84 | 35 | 147 | 61 | 7 | 2 | Comparative Example |
| 25 | 73 | 7 (No cooling) | 120 | 73 | 6.5 | 3 | Comparative Example |
| 26 | 73 | 35 | 121 | 66 | 6.5 | 3 | Comparative Example |

[Production of Toner 1]

Hydrophobic silica (number average primary particle size: 12 nm, hydrophobicity: 68) (0.6 parts by mass) and hydrophobic titanium oxide (number average primary particle size: 20 nm, hydrophobicity: 63) (1.0 part by mass) were added to toner matrix particles 1 (100 parts by mass), and were mixed with a Henschel mixer (manufactured by Nippon Coke & Engineering Co., Ltd.) at a circumferential velocity of a rotary blade of 35 mm/sec and 32° C. for 20 minutes. Coarse particles were then removed with a sieve having an opening of 45 μm, followed by treatment with an external additive, to produce toner 1.

[Production of Toners 2 to 26]

Toners 2 to 26 were produced as in toner 1, except that toner matrix particles 1 were replaced with toner matrix particles 2 to 26.

[Production of Developers 1 to 26]

Developers 1 to 26 used for evaluation of toners 1 to 26 were produced as described below.

(1) Preparation of Carrier

Ferrite core particles (100 parts by mass) and cyclohexyl methacrylate-methyl methacrylate (5:5) copolymer resin microparticles (5 parts by mass) were mixed with agitation in a high-speed mixer equipped with a stirring blade at 120° C. for 30 minutes. Resin coating layers were formed on the surfaces of the ferrite core particles through application of mechanical impact force, to prepare a carrier having a volume median particle size of 35 μm.

The volume median particle size of the carrier was measured with a laser diffraction particle size analyzer "HELOS" (manufactured by SYMPATEC) equipped with a wet disperser.

(2) Mixing of Toner and Carrier

The carrier was mixed with each of toners 1 to 26 (toner concentration: 6.5 mass %) in a micro V-type mixer (manufactured by Tsutsui Scientific Instruments Co., Ltd.) at a rotation rate of 45 rpm for 30 minutes. Developers 1 to 26 were thereby produced.

[Evaluation]

<Evaluation Apparatus>

Each developer was placed into a developing unit of a commercial color copier "bizhub PRO C1060" (manufactured by KONICA MINOLTA, INC.), and test images were formed for evaluation of the developer.

<Evaluation of Low-Temperature Fixing Properties (Under Offset)>

The under offset is an image defect involving detachment of a toner from a transfer medium (e.g., a sheet) due to insufficient fusion of the toner heated by a fixing unit.

Each of developers 1 to 26 was placed into the developing unit for evaluation of low-temperature fixing properties. The color copier was modified such that the fixing temperature, the amount of a toner to be deposited, and the system rate were adjustable. In detail, a solid image (toner density: 11.3 g/m$^2$) was printed on sheets NPI (128 g/m$^2$) (manufactured by Nippon Paper Industries Co., Ltd.) with the modified apparatus. The fixation rate was adjusted to 300 mm/sec, the temperature of a fixing belt was varied from 100 to 200° C. in 5° C. increments, and the temperature of a fixing roller was adjusted to 100° C. The temperature of the fixing belt was measured during fixation, and the minimum fixing temperature at which no under offset occurred was determined for evaluation of low-temperature fixing properties. A lower minimum fixing temperature indicates superior low-temperature fixing properties. A developer exhibiting a minimum fixing temperature of lower than 145° C. was acceptable.

(Evaluation Criteria)

A: A minimum fixing temperature of lower than 120° C.

B: A minimum fixing temperature of 120° C. or higher and lower than 135° C.

C: A minimum fixing temperature of 135° C. or higher and lower than 145° C.

D: A minimum fixing temperature of 145° C. or higher

<Thermal Resistance During Storage>

A toner (0.5 g) was placed in a 10-mL glass vial having an inner diameter of 21 mm. The vial was sealed with a lid and was shaken 600 times at room temperature with Tap Denser KYT-2000 (manufactured by Seishin Enterprise Co., Ltd.). The lid was removed, and the vial was left at 57.5° C. and 35% RH for two hours. Subsequently, the toner was carefully placed on a 48-mesh sieve (opening: 350 μm) to prevent disintegration of coagulated toner. The sieve was set on a powder tester (manufactured by Hosokawa Micron) and was fixed with a presser bar and a knob nut. The intensity of vibration was adjusted (vibration width: 1 mm), and the sieve was vibrated for 10 seconds. The proportion (mass %) of the residual toner on the sieve was determined.

The toner coagulation rate was calculated from Expression (A):

$$\text{toner coagulation rate (\%)} = [(\text{mass (g) of the residual toner on the sieve})/0.5\ (\text{g})] \times 100 \qquad \text{Expression (A):}$$

The thermal resistance during storage of a toner was evaluated on the basis of the following criteria.

(Evaluation Criteria)

A: a toner coagulation rate of less than 10 mass % (very high thermal resistance during storage of toner)

B: a toner coagulation rate of 10 mass % or more and less than 15 mass % (high thermal resistance during storage of toner)

C: a toner coagulation rate of 15 mass % or more and less than 20 mass % (slightly poor thermal resistance during storage of toner, practically acceptable)

D: a toner coagulation rate of 20% or more (poor thermal resistance during storage of toner, practically unacceptable)

<Releasability During Fixation>

Paper sheets used for evaluation (Kinfuji, 85 g/m$^2$, long-grain paper) (manufactured by Oji Paper Co., Ltd.) were conditioned at normal temperature and normal humidity (NN environment: 25° C., 50% RH) overnight. Entirely solid images with different toner densities (g/m$^2$) were printed on the sheets under the following fixation conditions: top margin: 5 mm, upper press temperature: 195° C., and lower press temperature: 120° C. The toner density (g/m$^2$) of the solid image immediately before occurrence of paper jam was determined and defined as "critical toner density" for evaluation of releasability during fixation. A higher critical toner density indicates superior releasability. A toner exhibiting a critical toner density of 2.5 g/m$^2$ or more was acceptable. This test was performed at normal temperature and normal humidity (NN environment: 25° C., 50% RH).

The releasability during fixation of a toner was evaluated on the basis of the following criteria.

(Evaluation Criteria)

A: a critical toner density of 4.5 g/m$^2$ or more (very high releasability during fixation of toner)

B: a critical toner density of 3.5 g/m$^2$ or more and less than 4.5 g/m$^2$ (high releasability during fixation of toner)

C: a critical toner density of 2.5 g/m$^2$ or more and less than 3.5 g/m$^2$ (practically acceptable releasability during fixation of toner)

D: a critical toner density of less than 2.5 g/m$^2$ (poor releasability during fixation of toner, practically unacceptable)

<HH Transfer Efficiency>

A solid image (test image) (10 cm×10 cm) were printed on paper sheets at high temperature and high humidity (HH environment: 30° C., 80% RH). The mass of a toner deposited on the photoreceptor (W before transfer) and the mass of a toner transferred and deposited onto a paper sheet (W after transfer) were measured, and the transfer rate was calculated by Expression (B) described below for evaluation of HH transfer efficiency. The results are shown in TABLE 3. A toner exhibiting a transfer rate of 85% or more was acceptable.

$$\text{transfer rate (\%)}=[(W \text{ after transfer})/(W \text{ before transfer})]\times 100 \quad \text{Expression (B):}$$

(Evaluation Criteria)

B: 90% or more

C: 85% or more and less than 90%

D: less than 85%

<GI (Image Roughness)>

For evaluation of developers 1 to 26, a commercial color copier "bizhub PRO C1060" (manufactured by KONICA MINOLTA, INC.) was modified such that the surface temperature of a heating roller in a fixing unit was varied within a range of 100 to 200° C. The surface temperature of the heating roller was adjusted to the lowest fixing temperature (i.e., higher one of the aforementioned low-temperature offset temperature and the lower limit of the fixing temperature), and a solid image (100% image) (toner density: 10 mg/cm$^2$) and a 50% shaded image were printed on an art (coated) sheet (basis weight: 250 g/m$^2$). The graininess index (GI) of the 50% shaded image was determined with an image analyzing system "GI-es-8500AAC" (manufactured by NATIONAL INSTRUMENT). A GI of less than 0.22 indicates that the toner provides a practically acceptable image with reduced roughness.

(Evaluation Criteria)

B: less than 0.20

C: 0.20 or more and less than 0.22

D: 0.22 or more

As illustrated in TABLE 3, the method of the present invention can produce a toner for developing electrostatic images, the toner having high compatibility between thermal resistance during storage and low-temperature fixing properties, exhibiting improved charging properties, and providing high-quality images.

What is claimed is:

1. A method of producing a toner for developing electrostatic images, the toner comprising a toner matrix particle having a core-shell structure, wherein the toner matrix particle comprising a core particle comprising an amorphous resin A and a crystalline material, and a shell comprising an amorphous resin B, the shell comprising a phase of the amorphous resin B that is not fused with the core particle at the interface, and the amorphous resin A differing from the amorphous resin B, the method comprising the steps of:

Step I) dispersing at least the amorphous resin A and the crystalline material in an aqueous medium to prepare a dispersion, and adjusting a temperature of the dispersion to be equal to or higher than (a glass transition temperature ($T_{g\text{-}a}$) of the amorphous resin A+10)° C. and equal to or lower than (a melting point ($T_{m\text{-}c}$) of the crystalline material+10)° C., to prepare a core particle dispersion through coagulation and coalescence of at least the amorphous resin A and the crystalline material;

Step II) cooling the core particle dispersion prepared in Step I to a temperature equal to or lower than the glass transition temperature ($T_{g\text{-}a}$) of the amorphous resin A; and

TABLE 3

| Toner matrix | | Results of evaluation | | | | | |
|---|---|---|---|---|---|---|---|
| Toner No. | particle No. | Low-temperature fixing properties | Thermal resistance during storage | Releasability during fixation | HH transfer efficiency | GI value | Note |
| 1 | 1 | B | B | B | C | C | Example |
| 2 | 2 | B | A | B | B | B | Example |
| 3 | 3 | C | A | C | B | B | Example |
| 4 | 4 | B | B | B | C | B | Example |
| 5 | 5 | C | B | B | C | C | Example |
| 6 | 6 | A | B | B | B | B | Example |
| 7 | 7 | B | C | C | B | B | Example |
| 8 | 8 | C | A | A | C | B | Example |
| 9 | 9 | B | B | B | C | C | Example |
| 10 | 10 | A | C | B | C | C | Example |
| 11 | 11 | B | B | C | B | B | Example |
| 12 | 12 | B | B | B | B | B | Example |
| 13 | 13 | C | B | B | C | B | Example |
| 14 | 14 | B | B | B | C | C | Example |
| 15 | 15 | B | B | C | C | C | Example |
| 16 | 16 | A | C | C | C | C | Example |
| 17 | 17 | C | A | B | B | B | Example |
| 18 | 18 | B | C | B | C | C | Example |
| 19 | 19 | B | C | B | C | B | Example |
| 20 | 20 | C | B | D | B | B | Comparative Example |
| 21 | 21 | B | D | B | D | D | Comparative Example |
| 22 | 22 | B | C | C | D | D | Comparative Example |
| 23 | 23 | B | C | B | C | C | Example |
| 24 | 24 | B | C | B | D | D | Comparative Example |
| 25 | 25 | B | C | B | D | D | Comparative Example |
| 26 | 26 | B | C | B | D | D | Comparative Example |

Step III) adjusting a temperature of the core particle dispersion to be equal to or higher than (the glass transition temperature ($T_{g-a}$) of the amorphous resin A+5)° C. and equal to or lower than (a glass transition temperature ($T_{g-b}$) of the amorphous resin B+3)° C. after Step II, and then adding a dispersion of the amorphous resin B to the core particle dispersion, wherein Expressions 1 and 2 are satisfied in Step III:

$pH_b \leq pH_a$, and Expression 1:

$2 \leq pH_b \leq 5$ Expression 2:

where $pH_a$ represents the pH of the core particle dispersion at 25° C., and $pH_b$ represents the pH of the dispersion of the amorphous resin B at 25° C.

2. The method according to claim 1, wherein the core particle dispersion cooled in Step II contains a core particle having a shape factor SF-2 of 105 to 140.

3. The method according to claim 1, wherein the amorphous resin B added in Step III is a particle having a volume median particle size of 30 to 300 rm.

4. The method according to claim 1, wherein the amorphous resin A is a styrene-acrylic resin, and the amorphous resin B is a polyester resin.

5. The method according to claim 1, wherein the amorphous resin A is a polyester resin, and the amorphous resin B is a styrene-acrylic resin.

6. The method according to claim 4, wherein the polyester resin is an amorphous polyester resin chemically bonded to a styrene-acrylic resin.

7. The method according to claim 5, wherein the polyester resin is an amorphous polyester resin chemically bonded to a styrene-acrylic resin.

8. The method according to claim 6, wherein the amorphous polyester resin chemically bonded to the styrene-acrylic resin has a styrene-acrylic content of 5 to 30 mass %.

9. The method according to claim 7, wherein the amorphous polyester resin chemically bonded to the styrene-acrylic resin has a styrene-acrylic content of 5 to 30 mass %.

10. The method according to claim 1, wherein the amorphous resin A has a glass transition temperature $T_{g-a}$ of 35 to 50° C.

11. The method according to claim 1, wherein the amorphous resin B has a glass transition temperature $T_{g-b}$ of 53 to 63° C.

12. The method according to claim 1, wherein the crystalline material comprises a crystalline resin or a release agent, if the crystalline material is the releasing agent then the releasing agent is one selected from the group consisting of a hydrocarbon wax and an ester wax, and the crystalline material has a melting point ($T_{m-c}$) equal to or higher than (a glass transition temperature ($T_{g-b}$) of the amorphous resin B+3)° C.

13. The method according to claim 1, wherein the ratio of the mass of the amorphous resin B added in Step III to the total mass of a binder resin is 5 to 35, and the binder resin comprises amorphous resin A and amorphous resin B.

* * * * *